United States Patent [19]

Stoner

[11] Patent Number: 4,872,391

[45] Date of Patent: Oct. 10, 1989

[54] GUN FOR FIRING TELESCOPED AMMUNITION, PLUS SEARING MEANS

[75] Inventor: Eugene M. Stoner, Palm City, Fla.

[73] Assignee: Ares, Inc., Port Clinton, Ohio

[21] Appl. No.: 131,832

[22] Filed: Dec. 11, 1987

Related U.S. Application Data

[60] Division of Ser. No. 58,627, Jun. 2, 1987, abandoned, which is a continuation of Ser. No. 773,585, Sep. 9, 1985, abandoned.

[51] Int. Cl.[4] ..... F41D 10/08

[52] U.S. Cl. ..... 89/155; 42/15

[58] Field of Search ..... 89/156, 33.03, 149, 89/150, 155; 42/15, 39.5

[56] References Cited

U.S. PATENT DOCUMENTS

| | | | |
|---|---|---|---|
| 38,604 | 5/1863 | Rice . | |
| 658,010 | 9/1900 | Hoffmann . | |
| 3,431,820 | 3/1969 | Chinn et al. . | |
| 3,563,132 | 2/1971 | Cashen . | |
| 3,667,147 | 6/1972 | Goldin et al. | 89/33.03 |
| 4,309,933 | 1/1982 | Bains | 89/33.03 |
| 4,469,006 | 9/1984 | Teppa | 89/149 |

FOREIGN PATENT DOCUMENTS

| | | | |
|---|---|---|---|
| 216705 | 12/1941 | Switzerland | 89/149 |
| 313402 | 6/1929 | United Kingdom | 89/149 |

*Primary Examiner*—Harold J. Tudor

*Assistant Examiner*—Stephen Johnson

*Attorney, Agent, or Firm*—Allan R. Fowler

[57] ABSTRACT

A self-powered, belt-fed automatic gun for firing cylindrical, telescoped ammunition is described. Mounted in receiver portions of the gun, to which a barrel is connected, are a shell chamber, a chamber carrier assembly, a shell rammer assembly and shell feeding and casing ejecting assembly. The shell rammer and chamber carrier assemblies are mounted in the receiver for axial reciprocating movement, the chamber being interconnected with the carrier assembly so that recoil movement of the carrier assembly moves the chamber laterally from a firing position to a loading position, counterrecoil movement of the carrier assembly causing the chamber to move back to the firing position. Responsive to chamber movement from the firing position to the loading position a shell is moved into a feed position rearwardly adjacent to the chamber. Searing means are provided for enabling the rammer assembly to move forwardly in counterrecoil in advance of the carrier assembly, the rammer assembly ramming a shell from the feed position into the chamber, and thereby ramming a fired shell casing from the chamber into a forwardly adjacent ejecting chamber, before the carrier assembly is released for counterrecoil movement. A firing pin mounted on the carrier assembly causes firing of a shell in the chamber when the carrier assembly reaches its battery position.

15 Claims, 6 Drawing Sheets

GUN FOR FIRING TELESCOPED AMMUNITION, PLUS SEARING MEANS

This is a division of application Ser. No. 058,627 now abandoned, filed June 2, 1987, which is a continuation of application Ser. No. 773,585, filed Sept. 9, 1985, now abandoned.

BACKGROUND OF THE INVENTION

1. Field of the Invention

The present invention relates generally to the field of automatic guns and more particularly to the field of automatic guns configured for firing telescoped ammunition.

2. Discussion of the Prior Art

Over about the last century, since the introduction of cased ammunition, a great variety of automatic guns have been developed for military service throughout the world. Currently, automatic guns include assault pistols, submachine guns, automatic rifles, machine guns and automatic or machine cannon. Exemplary of such automatic guns are the present-day, multi-barrel Gatling cannon which are essentially motorized updates of the pre-1900, hand-cranked Gatling gun.

In many instances, new types of automatic guns have been developed in response to the introduction of new types of military weapons systems. As examples, introduction of military tanks and aircraft in World War I, gave rise to development of anti-tank and antiaircraft cannon and in air-to-air machine guns and cannon.

Once any particular class of automatic gun is introduced, continual re-designs, improvements and new designs are ordinarily developed to improve gun performance in areas of firing rate, range, accuracy and destructive power; to improve operational reliability; to reduce procurement, maintenance and repair costs; to reduce complexity and thereby improve producability an to make the guns easier and simpler to operate.

Gun design has, however, always been limited to a large extent by the types of ammunition readily available, partially in order to standardize weapons for logistic purposes and partially because of ammunition availability. For example, submachine guns have typically been developed so as to fire readily available, conventional pistol ammunition, and light machine guns have typically been developed to fire readily available, conventional rifle ammunition.

Moreover, when new types of automatic guns, for example anti-tank and antiaircraft guns, requiring new types of shells have been developed, the shells have typically been up-sized, down-sized or modified versions of conventional, previously available shells. As a result, conventional, preexisting shell design has, to a great extent, placed limitations on new gun design, particularly in such areas as ammunition handling and storage portions of the gun, including the gun receiver, shell feeder and shell magazine.

As is well known, conventional cased shells, with the exception of shotgun and most pistol shells, are comprised of a shell casing which is typically tapered towards, and necked down at, the forward end, and a projectile which is crimped into the forward end of the casing so as to extend forwardly therefrom. Consequently, such shells are not only sustantially longer than either the casing or the projectile, but are, as well, very non-uniform in cross-section. This relatively long, non-uniform cross-sectional shape of conventional shells results in various inherent gun design deficiencies. As an illustration, when belted ammunition is used to feed an automatic gun, the shells, because of their tapered shape, must usually be pulled rearwardly a shell length to extract the shell from the belt. Thereafter, the extracted shell must generally be moved back forwardly at least about two shell lengths in order to fully chamber the shell for firing. Such required shell movement necessarily requires a relatively long gun receiver which adds to gun weight, space requirements(for example, when mounted in a vehicle or aircraft) and usually also cost. Moreover, a relatively long shell feed path tends to limit the cycling rate of operational portions of the gun, thereby causing the gun's firing rate usually to be slower than would be possible for a shorter shell feed path. On the other hand, achieving a high firing rate with a long shell feed path may require excessively high velocity of operating parts of the gun, thereby causing increased mechanical stresses which reduce parts life and reduce reliability of operation.

Furthermore, the shape of long tapered shells of present configuration is not efficient insofar as ammunition storage in a shell magazine is concerned. For example, when conventional, tapered shells are stored in an ammunition belt, ammunition boxes in which the filled belts are stored contain substantial unutilized space, a significant disadvantage for weapons systems in which ammunition storage space is restricted and a large supply of ammunition is necessary.

Because of the inherent disadvantages associated with use of conventional, long, tapered shells, considerable interest exists, in some branches of the military, in developing cylindrical, telescoped ammunition in which the projectile is fully recessed into the casing. As a result, the entire shell is completely uniform in cross-section. Although such telescoped shells are typically somewhat larger in diameter than corresponding conventional shells of like calibre, telescoped shells are ordinarily substantially shorter than their counterpart, conventional shells, the advantages of being shorter and having a uniform cross-section more than offsetting the disadvantage of being larger in diameter.

An important advantage of cylindrical, telescoped shells is that, unlike conventional tapered shells, the cylindrical shells can, for feeding, be pushed through ammunition belt loops so that shell feeding operations can ordinarily be simplified. Another important advantage is that cylindrical, telescoped shells can be stored in a shell magazine with less wasted space. A given number of cylindrical, telescoped shells can, therefore, be stored in a smaller volume than can a like number of counterpart, conventional tapered shells, thereby reducing magazine size and weight. Alternatively, for a given magazine volume, a larger number of cylindrical, telescoped shells than of conventional shell can be stored.

A potential disadvantage, however, of cylindrical, telescoped shells is that, unlike conventional, tapered shells, there is no shoulder or enlarged diameter region to control and stop forward shell movement, as when the shells are fed into a firing chamber. Another potential disadvantage of cylindrical, telescoped shells is that the forward end of the shell is much greater in diameter than is the projectile so that projectile-barrel alignment problems may arise. Another potential disadvantage of telescoped shells as compared with counterpart conventional shells is that new shell production facilities are required and unknown production and ballistic problems may be encountered. In contrast, extensive production facilities exist for conventional, tapered shells and ballistic characteristics of such shells are well defined and known.

It appears, however, to be considered that the real and/or potential advantages of cylindrical, telescoped shells outweigh the real or potential disadvantages of such shells.

It is apparent that existing guns configured for use with conventional, tapered ammunition cannot interchangeably use cylindrical, telescoped shells. Moreover, it is probably undesirable to modify existing guns to fire telescoped ammunition even if such modification were economically feasible, since full benefit could not be made of the telescoped shells advantages.

As a result, development of cylindrical, telescoped shells requires parallel development of new generation of guns specifically designed to take full advantage of such shells.

It is, therefore, an objective of the present invention to provide a gun configured for firing cylindrical, telescoped ammunition.

Another object of the present invention is to provide an automatic gun configured for firing cylindrical, telescoped ammunition.

Still another object of the present invention is to provide an automatic gun having a firing chamber mounted for oscillating, along a line orthogonal to the barrel bore axis, into and out of alignment with the barrel, cylindrical, telescoped shells being loaded into the chamber when the chamber is out of alignment with the barrel and being fired when the chamber is aligned with the barrel.

Additional objects, advantages and features of the present invention will become apparent to those skilled in the art from the following description taken in conjunction with the accompanying drawings.

SUMMARY OF THE INVENTION

According to the present invention, a gun for firing cylindrically-shaped, telescoped ammunition comprises a receiver, a gun barrel, means connecting rearward end regions of the barrel to forward regions of the receiver and a shell chamber having formed longitudinally therethrough a cylindrical, shell-holding aperture sized to receive a cylindrical, telescoped shell. Included are means mounting the chamber in the receiver rearwardly of the barrel for linear sliding movement, in a direction orthogonal to the bore axis of the barrel, between a shell loading position in which the shell-holding aperture is out of axial alignment with the bore through the barrel and a shell firing position in which the shell-holding aperture is axially aligned with the barrel bore. A chamber carrier and means mounting the carrier in the receiver for axial sliding movement between a forwardmost, battery position and a rearward searing position are provided, as are means for interconnecting the chamber with the chamber carrier so as to cause the chamber to be in the shell loading position when the chamber carrier is in the rearward searing position and to be in the shell firing position when the carrier is in the forwardmost, battery position. Further included in the gun are means for causing movement of the chamber between the forwardmost, battery position and the rearward searing position, means for loading a shell into the chamber aperture when the chamber is in the shell loading position and means for causing firing of a shell held in the chamber aperture when the chamber is in the shell-firing position.

In an embodiment of the invention, means for interconnecting the chamber with the chamber carrier include means defining a cam track on the chamber carrier and include an interconnecting link, the interconnecting link being connected to the chamber and having a cam track follower engaging the chamber carrier cam track. Preferably, the cam track is a generally "S"-shaped recess formed along the chamber carrier, the cam track follower comprising a roller sized to roll along in the recess.

The means for loading a shell into the chamber aperture when the chamber is in the shell loading position preferably include shell feeding means for moving a shell into a pickup position rearwardly of the shell loading position and shell rammer means for ramming shells forwardly from the pickup position into the chamber aperture, thereby pushing a fired shell casing out of the chamber aperture, when the chamber is in the shell loading position. Comprising the shell rammer means may be a rammer body having a forwardly extending shell rammer fixed thereto. Included are means mounting the rammer means in the receiver for axial sliding movement between a rearward, searing position in which the shell rammer is rearward of a shell in the pickup position and a forwardmost, battery position in which the shell rammer is rearwardly adjacent the chamber when the chamber is in the shell loading position, and means for causing movement of the rammer means between the rearward, searing and forwardmost, battery positions.

Searing means, for searing up the chamber carrier and the rammer means when the chamber carrier and the rammer means are in their rearward, searing positions, are provided, as are means for releasing the searing means so as to release the rammer means and chamber carrier for forward movement thereof.

It is preferred that the searing means include a primary sear for searing up the rammer means and a secondary sear for searing up the chamber carrier. The sear releasing means then include triggering means connected for selectively releasing the primary sear and means responsive to forward movement of the rammer means to its forwardmost, battery position for causing release of the secondary sear. Configuration of the searing means causes the secondary sear to sear up the chamber carrier whenever the chamber carrier is moved rearwardly to its rearward searing position, provided that the rammer means is not at its forwardmost, battery position, but irrespective of whether or not the triggering means causes the primary sear to sear up the rammer means.

In an illustrative, self-powered automatic gun, the means for causing movement of the chamber carrier between its forwardmost, battery position and its rearward, searing position, as well as the means for causing movement of the rammer means between its forwardmost, battery position, and its rearward, searing position, comprise a gas operated piston connected for causing, in response to high pressure gases caused by the firing of a shell held in the chamber aperture when the chamber is in the shell firing position, rearward, recoil movement of the chamber carrier and rammer means from their forwardmost, battery positions to their rearward, searing positions. Preferably, the piston is in rearward pushing engagement with the rammer means, the rammer means including means for pushing the chamber carrier rearwardly when the piston pushes the rammer means rearwardly. Additionally the means for causing movement of the chamber carrier between its forwardmost, battery position and its rearward, searing position and the means for causing movement of the rammer means between its forwardmost, battery position and its rearward, searing position preferably comprise first drive means connected between the rammer means and the receiver and second drive means connected between the chamber carrier and the receiver. The first drive means has a spring which is compressed by the rammer means moving rearwardly from its forwardmost position towards its rearward, searing position, the compressed first drive means spring thereafter causing movement of the rammer means back forwardly towards its forwardmost position. The second drive means has a spring which is compressed by the chamber carrier moving rearwardly from its forwardmost position towards its rearward, searing position, the compressed second drive means spring thereafter causing movement of the chamber carrier back forwardly towards its forwardmost position.

To enable loading of the gun, the means for loading a shell into the chamber aperture when the chamber is in the shell loading position include shell feeding means, responsive to movement of the chamber from the shell firing position to the shell loading position, for advancing a shell from an associated shell supply through a shell feeding port in the receiver into a shell pickup position rearwardly adjacent to, and in axial alignment with, the chamber aperture. There is defined a fired shell casing discharge position forwardly adjacent to, and axially aligned with, the chamber aperture when the chamber is in the shell loading position and there are included shell ejecting means, responsive to movement of the chamber from the shell firing position to the shell loading position, for moving a fired shell casing from the discharge position to an ejection port of the receiver for ejection therefrom. Adjacent ends of the shell feeding port and the casing ejection port are longitudinally spaced apart a distance equal to at least about the length of shells fired by the gun and the shell ramming and shell casing discharging positions are laterally offset from the barrel bore axis.

Preferably the shell firing means include a firing pin connected to the chamber carrier in a position causing the firing pin to impact and fire a shell held in the chamber aperture when the chamber carrier moves forwardly into the battery position, thereby causing the chamber to be moved into the shell firing position. Also preferably, the shell rammer body moving means cooperate with the chamber carrier moving means so that the chamber carrier is in its rearward, searing position, with the chamber in the shell loading position, when the rammer body is moved from its rearward, searing position to its forwardmost, battery position. Sear control means are provided which unsear the rammer body a sufficient time enabling the rammer body to be moved by the rammer moving means from the rearward, searing position to the forwardmost position before the chamber carrier is unseared, the sear control means including chamber carrier unsearing means which are responsive to the rammer body being moved to its forwardmost, battery position for unsearing the chamber carrier.

According to the preferred embodiment, the receiver includes means for accepting linked belt ammunition through the shell feeding port and includes means opposite the shell feeding port for defining a belt link ejection port through which disengaged inks of the ammunition belt are discharged.

The shell feeding means are responsive to movement of the chamber to the shell loading position for advancing the ammunition belt through the belt feed port so as to position a shell held in the belt in the shell pickup position and also for moving a shell casing in the casing discharge position out of the casing ejection port.

There are also preferably included recoil buffering means mounted in the receiver in the path of rearward travel of the rammer means and the chamber carrier for absorbing rearward recoil energy thereof and thereby stop rearward recoil movement thereof.

Some relative lateral movement of a shell being loaded into the chamber aperture relative to the shell rammer is preferably enabled by forming the shell rammer of a laterally flexible member which is substantially rigid in an axially compressive direction.

There is thereby provided a gun, preferably a self-powered, automatic gun, specifically configured for firing cylindrical, telescoped ammunition.

BRIEF DESCRIPTION OF THE DRAWINGS

A better understanding of the present invention may be had from a consideration of the following detailed description, taken in conjunction with the accompanying drawings in which:

FIG. 8(*a*) showing position of chamber, chamber carrier assembly and shell rammer assembly portions of the gun at the instant ($t=0$) of firing; FIG. 8(*b*) showing the loading position and full recoil/searing positions of the chamber carrier and shell rammer assemblies of shortly after firing ($t \cong$ 25msec), FIG. 8(*c*) showing the chamber re-loaded, the rammer assembly in its forwardmost position and the chamber carrier assembly in the seared up position, a still later time ($t \cong$ 40msec) after firing and FIG. 8(*d*) showing the reloaded chamber back in the firing position and the rammer assembly in its battery position and the chamber carrier assembly moving into its battery position at a still later time ($t \cong$ 75msec) before a next firing (times based on a 750 round per minute firing rate with an 80 msec cycling time).

DESCRIPTION OF THE PREFERRED EMBODIMENT

Figure 1:
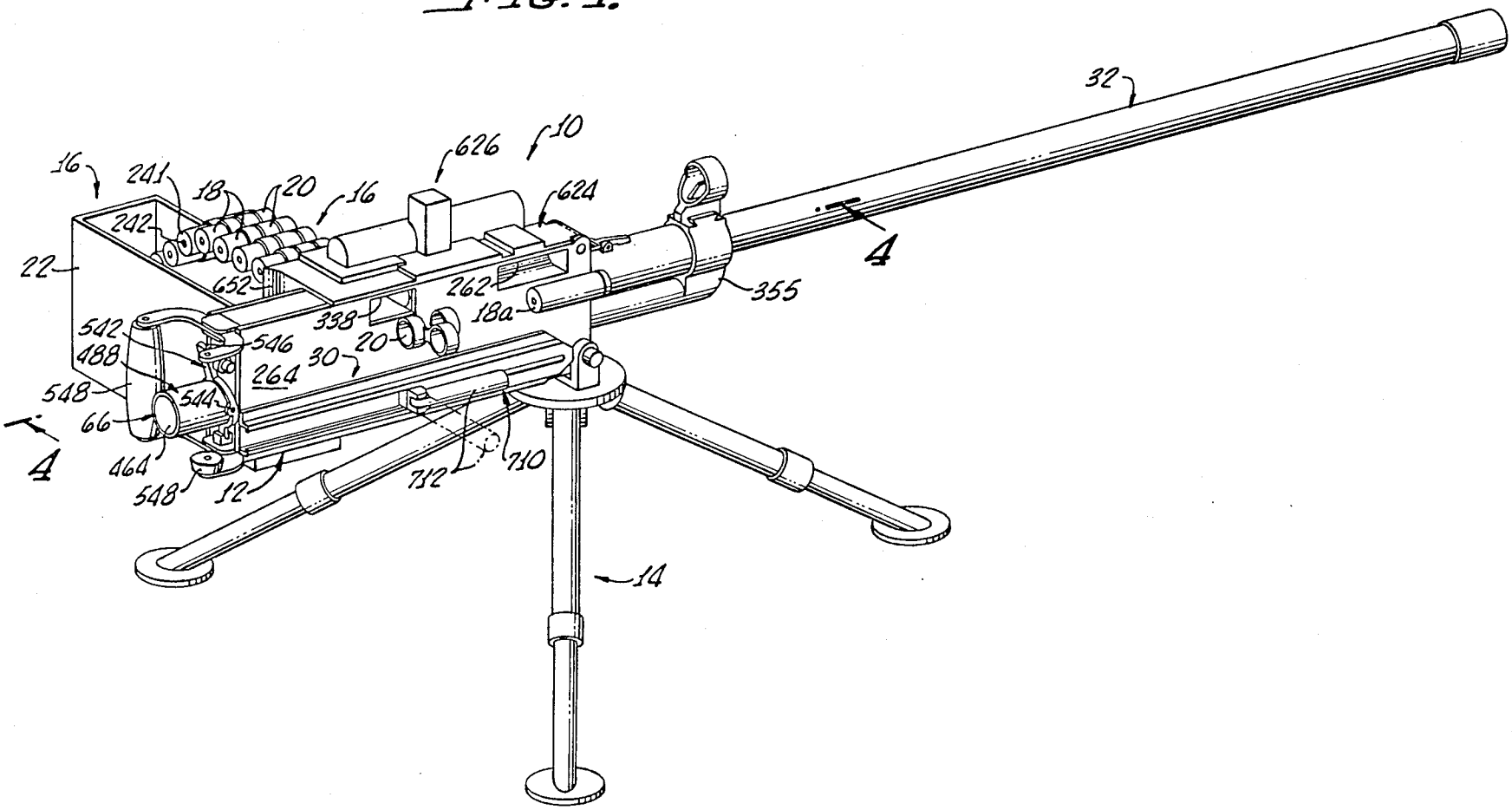
FIG. 1 is a partially cutaway perspective of an exemplary self-powered machine gun according to the present invention.

Shown in FIG. 1 is a weapon system 10 which includes a self-powered, automatic gun 12 illustrative of the present invention. Included in weapon system 10 is a conventional tripod-type gun mount 14 upon which gun 12 is pivotally mounted for traversing movement. Connected in shell feeding relationship to gun 12 is a disentegrating-type ammunition belt 16 which holds a large number of cylindrically-shaped, telescoped shells 18. Comprising exemplary ammunition belt 16 are a number of belt links 20, each adjacent pair of which are releasably held together by one of shells 18. Belt links 20 are configured so that shells 18 can be pushed therethrough for loading into gun 12 as described below. In belt 16 shells 18 not only hold links 20 together, but also function as link pivot pins enabling the belt to be closely folded so as to provide high shell density storage in an associated ammunition box 22 supported from gun 12.

By way of illustration, with no limitation being thereby intended or implied, shells 18 may be of the type disclosed in my copending U.S. Pat. application Ser. No. 719,520, filed on Apr. 3, 1985. As such, shells 18 have the shape of right circular cylinders, each comprising a casing 18*a* in which is fully recessed a projectile 21 (FIG. 8). As a result, insofar as handling is concerned, unfired shells 18 and casings 18*a* thereof remaining after firing of the shell are indistinguishable. That is, exterior shape and dimensions of the shells 18, unlike those of conventional shells, remain unchanged with firing of the shells.

Also by way of illustration and also with no limitation being thereby intended or implied, ammunition belt 16 and belt links 20 may advantageously be of the type disclosed in my copending U.S. Pat. application Ser. No. 719,520 filed on Apr. 3, 1985. As such, belt links 20 may be constructed of strong, light-weight plastic so as to minimize weight of ammunition belt 16.

It is, of course, to be appreciated that types of telescoped shells 18 other than that disclosed in my above-referenced copending application may be used, the only constraint being that the shells be of uniform cross section along their length. By uniform in cross section it is meant that the outer surface of the shell fits within a uniformly cylindrical envelope. This requirement is satisfied by shells which may have various grooves or recesses 22 formed into outer surfaces for such purposes as enabling the retaining of the shells in belt links 20 or to identify the projectile end. For feeding and handling purposes such shells are still considered as being of uniform cross section as the term is used herein.

Also, it is to be appreciated that feed systems other than belt 16 may be used to feed shells 18 into gun 12. Thus, fixed shell-holding magazines, such as that disclosed in my copending application serial No. 563,152 filed on Dec. 19, 1983, may alternatively be used, at least on some types of guns implementing the present invention.

Still further, it should be understood that although for purposes of describing the present invention, gun 12 is illustrated and described herein as being a machine gun, for example, a 0.50 calibre machine gun, of generally conventional exterior appearance, the invention is not limited thereto. It is considered that the present invention is applicable to virtually any size of automatic or semi-automatic gun from pistols and rifles up to cannon, the invention being considered to be fully scaleable up or down in size.

Figure 4:
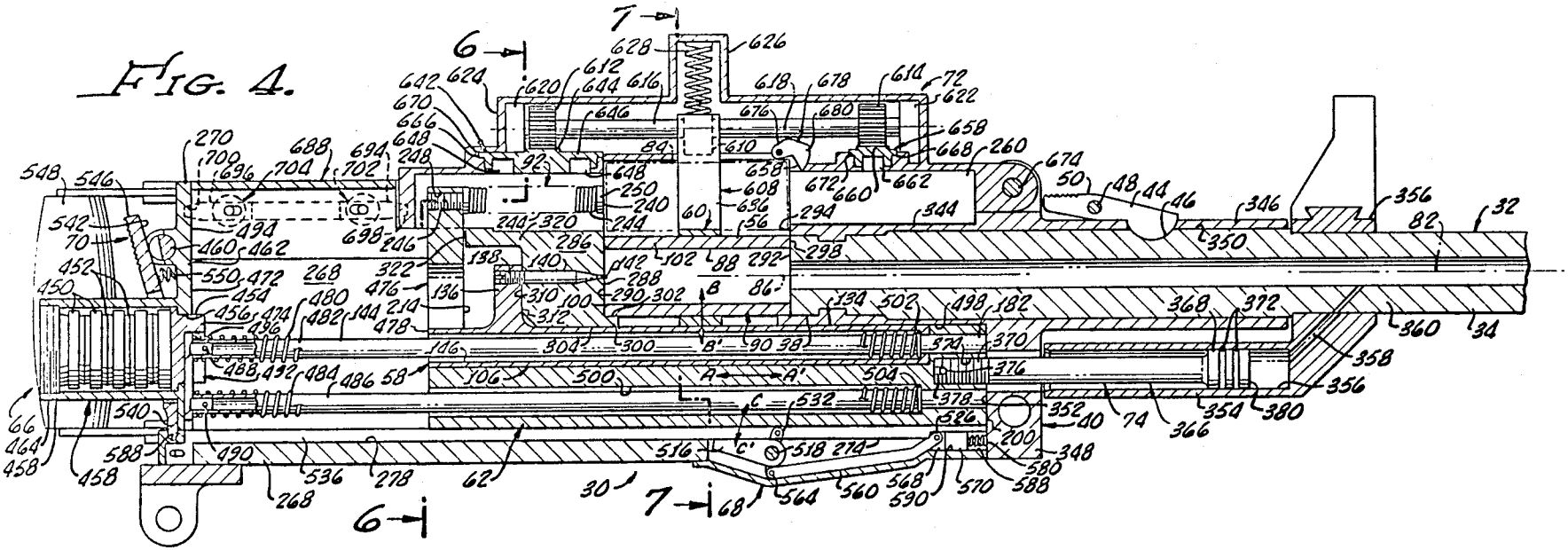
FIG. 4 is a longitudinal cross-sectional drawing, taken along lines 4—4 of FIG. 1, showing additional features of the machine gun receiver portion.
Figure 5:
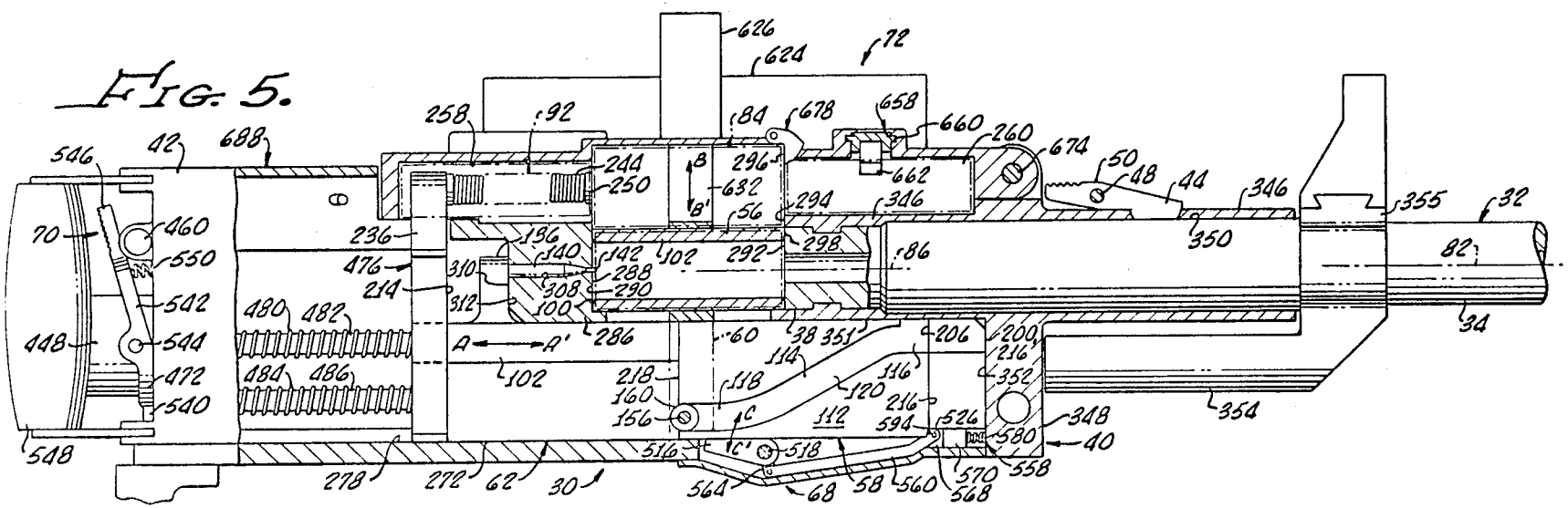
FIG. 5 is a longitudinal cross-sectional drawing, partially in elevation, taken generally along the same line 4—4 as is FIG. 4, and showing additional features of the machine gun receiver portion.

Still described generally, gun 12 comprises a receiver assembly 30 and a barrel assembly 32 (FIGS. 1, 2, 4 and 5). As best shown in FIGS. 4 and 5, barrel assembly 32 comprises a generally conventional gun barrel 34, a rearward end of which is preferably configured, for example, by having interrupted screw threads 38, for detachable connection to a forward portion 40 of a receiver housing 42. Barrel 34 is locked against rotation in housing portion 40 by a spring loaded locking element or key 44, portions of which extend downwardly into an arcuate barrel recess or keyway 46. Key 44 is pivotally mounted, by a pin 48, to a bracket 50 formed as part of housing forward portion 40.

Within receiver housing 42 are mounted, as shown in FIGS. 2–5 and as more specifically disclosed below, a cylindrically-shaped shell holding chamber 56; a chamber carrier assembly 58, to which the chamber is interconnected by a link assembly 60; a shell rammer assembly 62, rammer assembly and chamber carrier assembly operating or driving means 64; recoil buffer means 66; rammer assembly and chamber carrier assembly searing means 68; gun triggering means 70; shell feeding and fired shell casing ejecting means 72 and rammer assembly and chamber carrier assembly gas operating means 74.

In order that the detailed description of the preferred embodiment can be more readily followed and understood, major operational aspects illustating interaction among the various major components will first be considered. In general, during firing of gun 12, chamber carrier assembly 58 is caused to reciprocate in receiver housing 42, in recoil and counterrecoil, in a direction (direction of Arrows A—A', FIGS. 4 and 5) parallel to a barrel bore axis 82. Such recoil and counterrecoil movement of chamber carrier assembly 58 is thus is similar to that of a conventional bolt group (bolt and bolt carrier) of coventional automatic and semi automatic guns.

In response to the recoil and counterrecoil movement of chamber carrier assembly 58, chamber 56 is caused, by camming action between link assembly 60 and the chamber carrier assembly, to linearly reciprocate in a lateral direction (direction of Arrows B—B') orthogonal to barrel bore axis 82. Such chamber reciprocation is between a first, shell feeding position 84, in which a longitudinal axis 86 of a shell-holding aperture 88 formed through chamber 56 is laterally offset from barrel bore axis 82, and a second, shell firing position 90 in which the chamber aperture axis 86 is aligned with the barrel bore axis.

When chamber 56 is in the shell loading position (corresponding to chamber carrier assembly 58 being in a rearward, searing position), a shell 18 is loaded forwardly into chamber aperture 88, from shell feeding and fired shell casing ejecting means 72, by forward movement of rammer assembly 62, which is slidably mounted in receiver housing 42 for reciprocating movement in a direction (direction of Arrows A—A') parallel to bore axis 82. If at the time of such shell loading, a fired shell casing 18*a* is held in chamber aperture 88, the loading of a shell 18 forwardly into the aperture pushes the casing forwardly out of the aperture for subsequent ejection from gun 12 by shell feeding and casing ejecting means As chamber carrier assembly 58 then moves forwardly to its forwardmost, battery position (FIGS. 4 and 5) chamber 56 is moved downwardly from shell loading position 84 to shell firing position 90, at which chamber position the shell 18 contained therein is fired. High pressure barrel gases resulting from firing of the shell 18, operating through gas operating means 74 causes rearward recoil movement of rammer assembly 62 and chamber carrier assembly 58, thereby moving chamber 56 back up to shell loading position 84 in readiness for being reloaded.

Recoil buffer means 66 are mounted to receiver housing 42 in the recoil path of rammer assembly 62 and chamber carrier assembly 58 to absorb, upon impact thereby, recoil energy and stop recoil travel of both such assemblies. Searing means 68 are configured for separately searing up both rammer assembly 62 and chamber carrier assembly 58 in their rearwardmost positions if firing of gun 12 is to be stopped; that is, if triggering means 70 are not actuated. If, on the other hand, triggering means 70 are kept actuated, searing means 68 in any event sear up chamber carrier assembly 58 in its rearwardmost position until rammer assembly 62 is driven forwardly, by driving means 64, to its forwardmost position, in the process reloading chamber aperture 88. At its forwardmost position, rammer assembly 62 causes unsearing of chamber carrier assembly 58, which is then driven forwardly, by the driving means 64, to its forwardmost position, thereby causing the reloaded chamber 56 to be moved back down into firing position 90 for the next firing of gun 12. When firing is stopped by searing up both rammer assembly 62 and carrier assembly 58, upon subsequent firing of gun 12 (by actuating triggering means 70), rammer assembly 62 is unseared first to cause reloading of chamber 56 before chamber carrier assembly 58 is unseared to cause moving of the reloaded chamber back down to firing position 90.

More particularly described, chamber 56 is, for example, as shown in FIGS. 2–5, formed in cylindrical, tubular shape having an axial length equal to that of a single shell 18. Diameter of shell-holding aperture 88, which is centered in chamber 56, enables a shell 18 to slidingly fit in the aperture without substantial clearance. A rearward end region 100 (FIG. 4) of chamber 56 is beveled or chamfered to enlarge the diameter of aperture 88 for facilitating forward insertion of shells 18 into the aperture. Thickness of a chamber wall 102 (defining aperture 88) depends upon tensile strength of the chamber material, shell size and firing stresses. In any event, thickness of wall 102 is made sufficient to withstand radial forces generated during firing of a shell 18 held in aperture 88.

Figure 2:
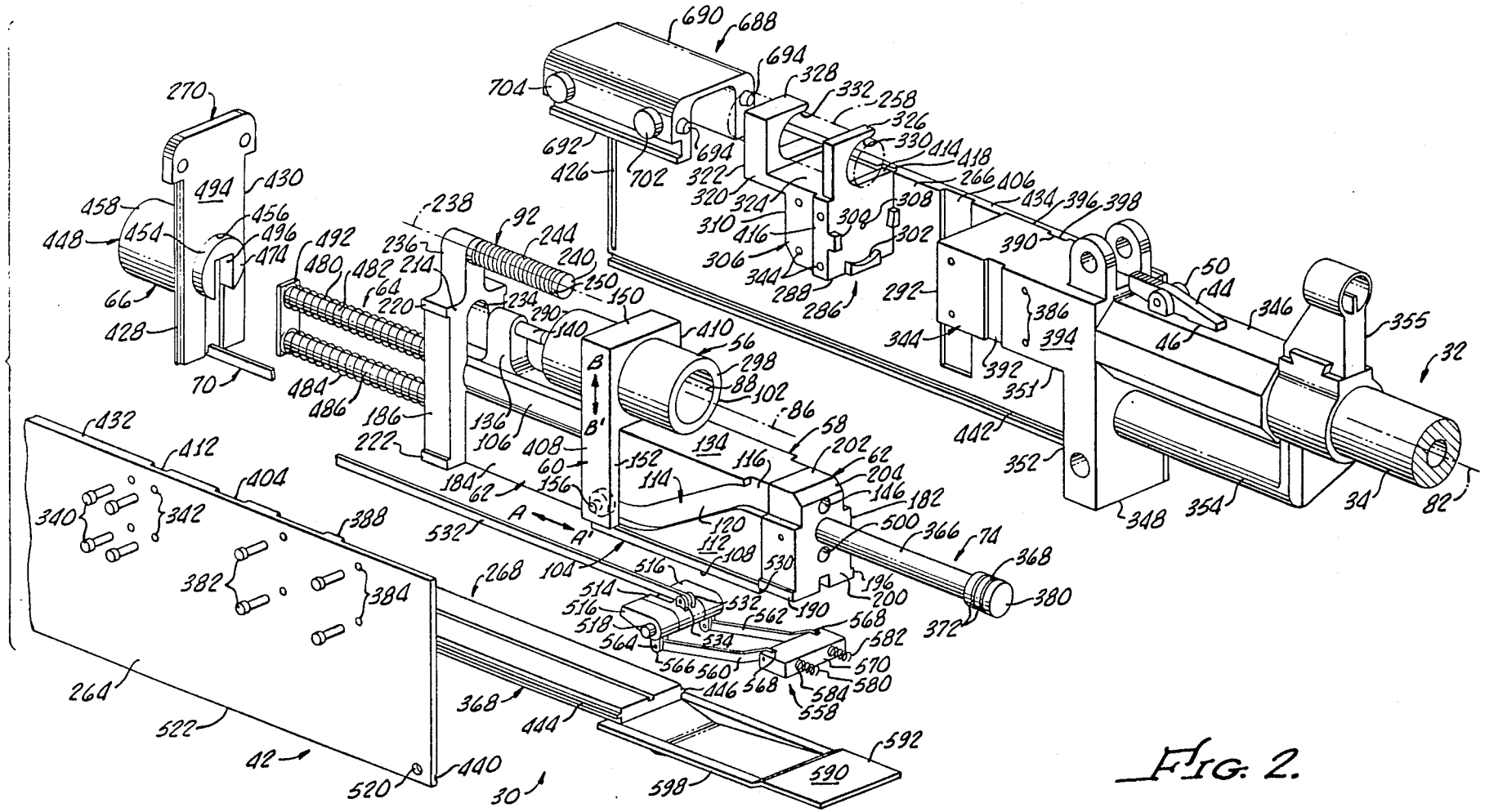
FIG. 2 is an exploded perspective drawing of receiver portions of the machine gun of FIG. 1.
Figure 3:
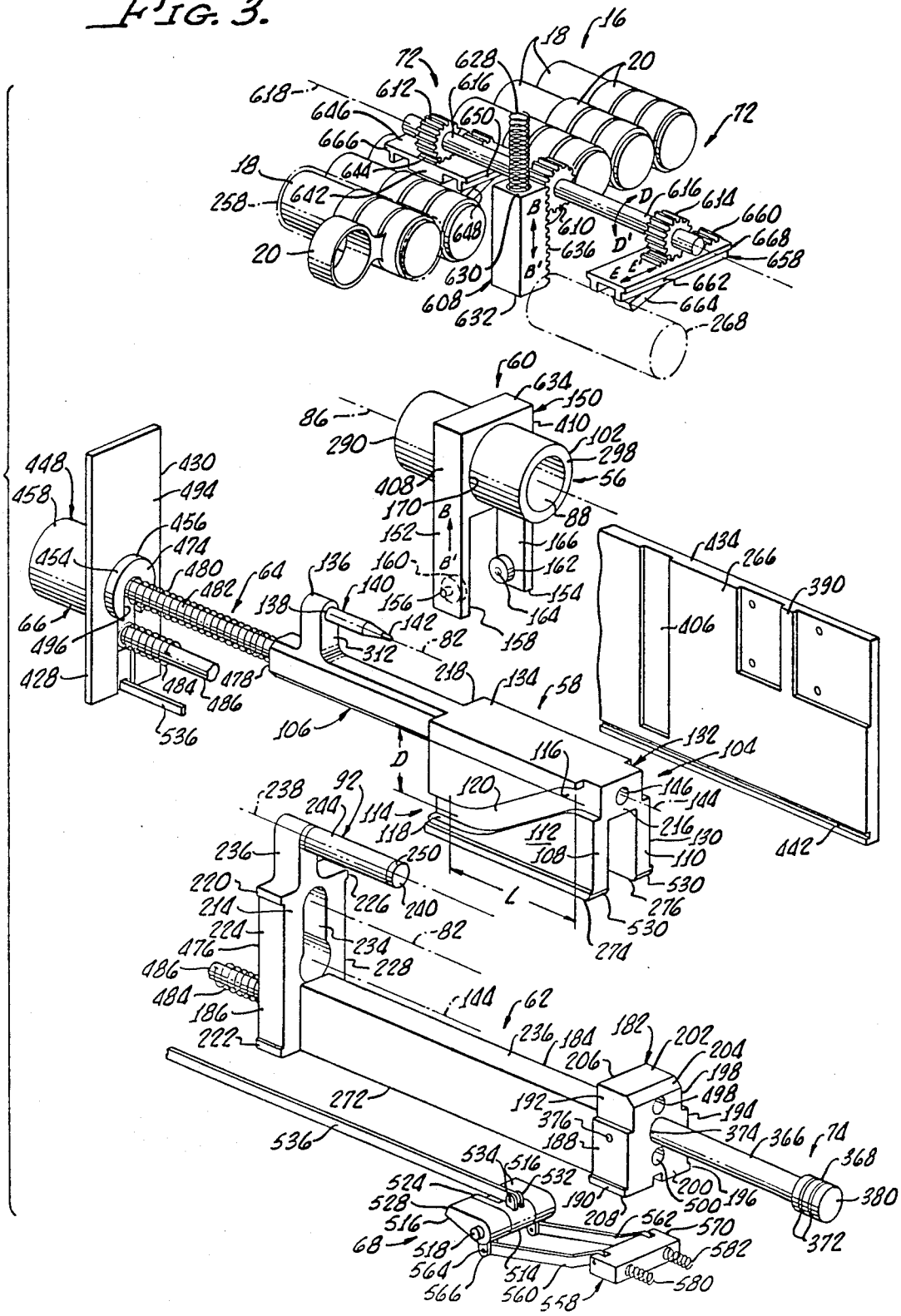
FIG. 3 is an exploded perspective drawing of operating parts mounted in the machine gun receiver portion.

Comprising chamber carrier assembly 58 are a saddle-shaped, forward portion 104 and an axially elongated rearward portion 106 (FIGS. 2 and 3). Forward portion 104 is formed having first and second, laterally spaced apart legs 108 and 110, respectively, which, as described below, straddle portions of rammer assembly 62. Formed along first leg 108, into an outer surface 112 thereof, is a first cam track or cam track groove 114. Shaped generally in the form of a flattened or axially elongated "S", first cam track 114 has a flat, upper forward segment 116 and a flat, lower rearward segment 118, both of which are parallel (upon assembly of gun 12) with barrel bore axis 82. Smoothly interconnecting such segments 116 and 118 is a downwardly and rearwardly inclined intermediate segment 120. Since cam track 114 controls sliding movement of chamber 56, the centerline distance, "D" between upper forward and lower rearward cam track segments 116 and 118 (FIG. 3) is equal to the lateral separation distance between chamber shell loading position 84 and chamber shell firing position 90 (FIG. 4). Preferably, such separation distance "D" is about equal to the outside diameter of chamber 56 and is, in any event, sufficiently great so that when chamber 56 is in shell loading position 84, chamber aperture 88 is clear of barrel 34. Axial length "L", of cam track intermediate segment 120 is preferably no greater than about one shell length, such length establishing the amount of axial travel of chamber carrier assembly 58 required to move chamber 56 between its respective shell loading and shell firing positions 84 and 90. Formed into an outer surface 130 of second leg 110 is a second cam track or cam track groove 132 which is a mirror image of above-described first cam track 114.

Figure 6:
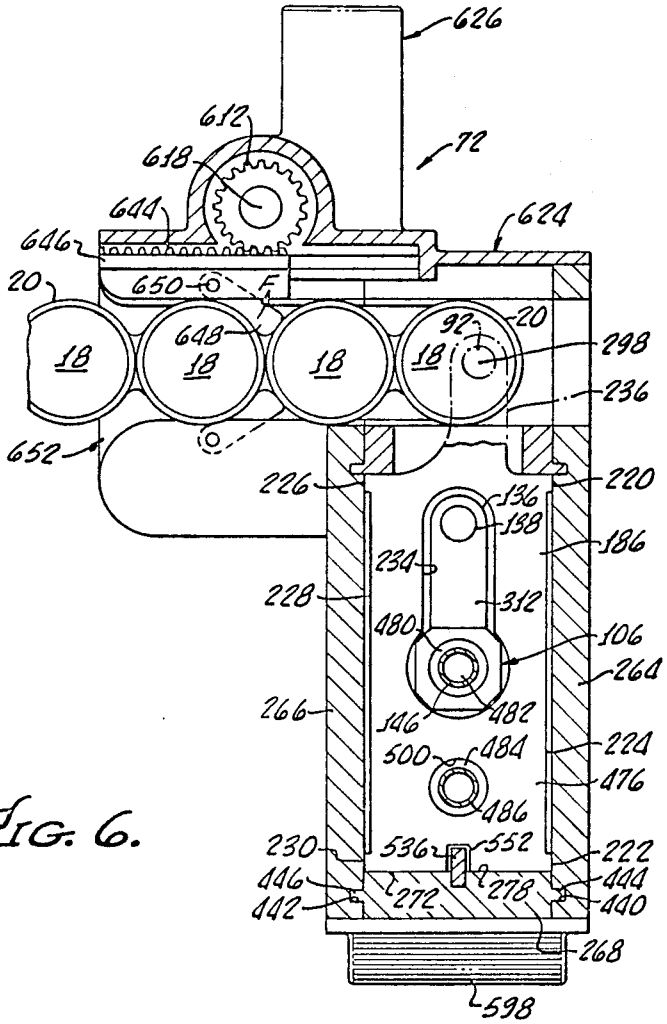
FIG. 6 is a transverse cross-sectional drawing, taken along line 6—6 of FIG. 4, showing additional features of the machine gun receiver portion.

Extending rearwardly of carrier assembly forward portion 104 is rearward portion 106; upwardly projecting from a flat upper surface 134 thereof is a bracket 136 (FIGS. 3 6). Threaded into an axial aperture 138 formed through bracket 136 is an elongate, generally conventionally-shaped firing pin 140 having a comparatively slender, shell impacting tip 142. Firing pin 140 is positioned so that, upon assembly of carrier assembly 58 in receiver housing 42, a longitudinal axis therethrough is coincident with barrel bore axis 82. Formed longitudinally through carrier assembly forward and rearward portions 104 and 106, relatively adjacent upper surface 134 and along a longitudinal axis 144 is an aperture 146 for receiving portions of driving means 64, as described below.

Figure 7:
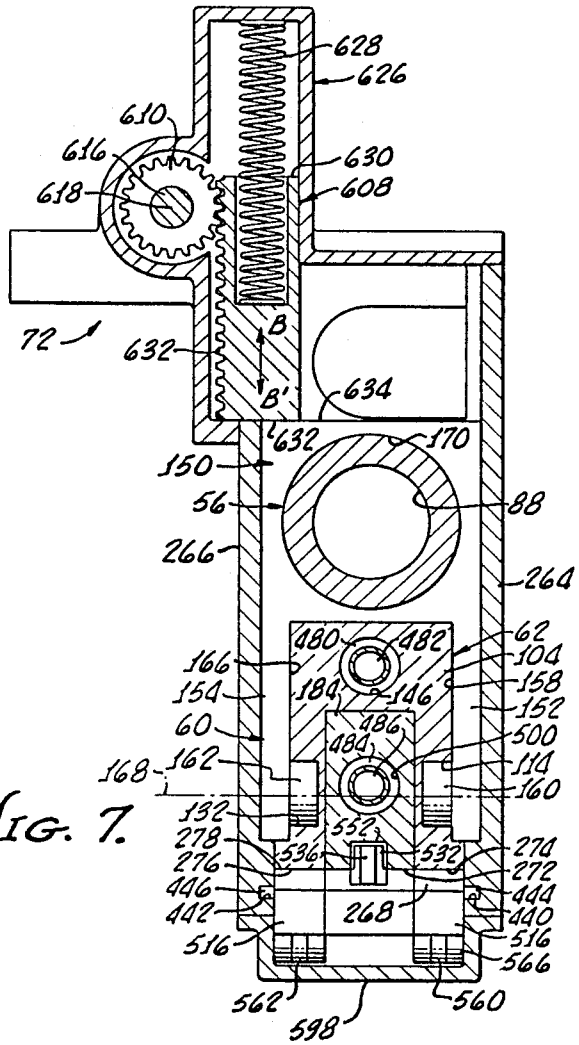
FIG. 7 is a transverse cross-sectional drawing, taken along line 7—7 of FIG. 4, showing features of the machine gun receiver portion forward of the FIG. 6 cross-sectional drawing.

Interconnecting link assembly 60 (FIGS. 2–5 and 7) comprises a rectangular block 150 having respective first and second depending legs 152 and 154. Mounted by a pivot pin 156 to the lower end of first leg 152, at an inner surface 158 thereof, is a first roller-type, cam track follower 160. Similarly, a second cam track follower 162 is mounted, by a pivot pin 164, to second leg 154 at an inner surface 166 thereof. Cam Track followers 160 and 162 are on a common transverse axis 168 (FIG. 7). Lateral separation of legs 152 and 154 is such as to enable cam followers 160 and 162 to fit into chamber carrier assembly cam tracks 114 and 132, height of such legs being sufficient to permit link assembly 60 to slide axially relative to carrier assembly forward portion 104 with followers 160 and 162 in cam tracks 114 and 132. As described below, link assembly 60 is constrained in receiver housing 42 to lateral (up and down) movement only.

An aperture 170, sized to slidingly receive shell chamber 56, is formed axially through link assembly block 150 along a vertical (for the illustrated gun orientation) axis. Link assembly 60 and chamber carrier assembly 58, including cam tracks 114 and 132, are relatively dimensioned so that when chamber 56 is installed in link aperture 170 and link cam followers 160 and 162 are received into chamber carrier cam tracks 114 and 132, and the assembled parts are then installed in receiver housing 42, rearward movement (direction of Arrow A) of chamber carrier assembly 62 to its rearward, searing position causes, by the cam followers riding up the cam tracks, upward movement (direction of Arrow B) of the chamber into shell loading position 84. Conversely, forward movement (direction of Arrow A') of carrier assembly 62 to its forwardmost battery position causes, by cam followers 160 and 162 riding down cam tracks 114 and 132, downward movement (direction of Arrow B') of the chamber 56 into shell firing position 90 (FIGS. 4 and 5).

As best shown in FIG. 3, rammer assembly 62 comprises respective forward, intermediate and rearward portions 182, 184 and 186. Rammer assembly forward portion 182 is generally in the shape of a square block, with respective sidewardly projecting upper and lower guide regions 188 and 190 on one side 192 and corresponding guide regions 194 and 196 on the other side 198, and having a flat, transverse forward face 200 and flat upper surface 202. A beveled surface 204 joins face 200 and flat surface 202. Forward portion 182 also has a flat, transverse rearward surface 206 and a flat lower surface 208.

Rammer assembly intermediate portion 184 comprises an elongate bar of uniform, rectangular cross-section sized to slidingly fit between legs 108 and 110 of chamber carrier assembly 58. Accordingly, upon assembly (FIGS. 2 and 7), chamber carrier assembly forward portion 104 sits downwardly over rammer intermediate portion 184. Rammer assembly intermediate portion 184 is substantially longer than chamber carrier assembly forward portion 104. Thus, when assembled together, relative axial sliding movement between rammer assembly 62 and chamber carrier assembly 58 is permitted, the relative sliding movement being limited by rearward surface 206 of rammer assembly forward portion 182 and a flat, transverse forward surface 214 of rammer assembly rearward portion 186, such surfaces, at extremes of relative travel, respectively engaging a forward transverse surface or face 216 and a rearward transverse surface 218 of chamber carrier assembly forward portion 104. As shown, length of intermediate portion 184 may be about one and a quarter shell lengths.

Rammer assembly rearward portion 186 comprises a generally rectangular block having upper and lower guides 220 and 222 sidewardly projecting from one side 224, (FIGS. 2 and 6). Guide 222 corresponds to forward portion lower guide 190 and is axially aligned therewith. An upper guide 226, corresponding to upper guide 220, projects sidewardly from an opposite side 228 of rearward portion 186. A lower guide 230, corresponding to lower guide 222, projects sidewardly from side 228, such lower guide corresponding to, and being axially aligned with, lower guide 196 of forward portion 182.

A clearance aperture 234 is formed axially through rammer assembly rearward portion 186, above an upper surface 236 of intermediate portion 184. Upon assembly of rammer assembly 62 and carrier assembly 58, rearward carrier portion 106 (including bracket 136) extends rearwardly through aperture 234.

Shell rammer portion 92 is mounted to an upwardly extending region 236 of rammer assembly rearward portion 186, above aperture 234, and extends forwardly approximately two-thirds of a shell length from forward face 214 along an axis 238 parallel to barrel bore axis 82. The lateral separation distance between shell rammer portion axis 238 and barrel bore axis 82 is equal to the centerline separation between shell loading position 84 and shell firing position 90. Accordingly, when chamber carrier assembly 58 is moved rearwardly relative to link assembly 60 so that chamber 56 is elevated into shell-loading position 84, axis 238 of shell rammer portion 92 is at the same height as, and is parallel to, chamber aperture axis 86. However, shell rammer axis 238 is laterally offset from chamber axis 86 so that during shell loading a forward end 240 of the shell rammer portion does not impact a central, primer region 241 of a base surface 242 of shells 18 (FIG. 1).

A possibility exists that some shell movement in a plane orthogonal to rammer axis 238 may occur during loading (ramming) of a shell 18, into chamber aperture 88 and while rammer portion forward surface 240 is in driving engagement with shell base surface 241. To prevent possible shell or rammer damage should such shell movement occur during loading, rammer portion 92 is constructed to be laterally flexible while at the same time being longitudinally rigid. Rammer portion 92 may, therefore, be constructed of a closely wound, spiral spring 244, a rearward end of which is mounted onto forward regions of a pin 246 that is, in turn, partially recessed into an aperture 248 formed in rammer assembly portion 236. A shell base engaging end 240 is mounted into the forward end of spring 244.

Shell feeding and casing ejecting means 72 (FIGS. 2, 4 and 5) are, as more particularly described below, responsive to upward movement of link assembly 60, which moves chamber 56 from firing position 90 into shell feeding position 84, for advancing an end shell 18 held in belt 16, into a shell pickup position or chamber 258 located immediately behind, and in axial alignment with, shell loading position 84 (FIGS. 4 and 5). At the same time, shell feeding and casing ejecting means 72 cause ejection of a casing 18*a* of a fired shell from a casing ejecting position or chamber 260, immediately forwardly of, and axially aligned with, shell loading position 84, outwardly through a casing ejection port 262 defined in receiver 30 (FIG. 1).

As shown in FIGS. 4–7, rammer assembly 62 and chamber carrier assembly 58 are mounted in receiver housing 42 for axial sliding movement between forwardmost, battery positions and rearwardmost, recoil positions. Principally comprising receiver housing 42 are forward portion 40, a right hand side plate 264, a left hand side plate 266, a bottom plate 268 and a transverse, rearward end plate 270 (FIG. 2). Upon assembly, chamber carrier assembly forward portion 104 sits astride rammer assembly intermediate portion 184, with a lower surface 272 of rammer assembly 62 and with respective lower surfaces 274 and 276 of carrier assembly legs 108 and 110 resting on an upper surface 278 of receiver bottom plate 268. Rammer assembly 62, chamber carrier assembly 58, interconnecting link assembly 60, and chamber 56 are disposed between receiver housing side plates 264 and 266 forwardly of rearward end plate 270 and rearwardly and partially under housing forward portion 40.

A chamber and chamber carrier assembly guide member 286 (FIGS. 2, 4 and 5) is installed across receiver housing 42, between housing side plates 264 and 266. Guide member 286 is so configured and installed in housing 42 that a transverse forward face 288 thereof functions as a rearward guide surface for lateral, sliding movement of chamber 56 between firing position 90 and shell loading position 84. As a result, a rearward, annular surface 290 of chamber 56 slides along guide member forward face 288 as the chamber is moved between firing and loading positions 90 and 84. Forward guiding of chamber 56 is provided by several contiguous transverse surfaces or surface regions forwardly of the chamber: An annular, rearward end surface 292 of barrel 34, a rearward surface region 294 of housing forward portion 40 and an inner surface region 296 of shell feeding and casing ejecting means 72, a forward, annular surface 298 of chamber 56 sliding along such surfaces of surface regions as the chamber is moved between loading and firing positions 90 and 84.

Guide member 286 has projecting forwardly therefrom a plurality (three being shown) of short, arcuate lugs or ears 300 (FIG. 2) which are located on a common circle so that arcuate, inwardly-directed surfaces 302 thereof are on a diameter equal to outside diameter of chamber 56. Lugs 300 are lcoated on guide member 286 so that their surfaces 302 function as a stop for chamber 56 when the chamber is moved from loading position 84 into shell firing position 90. As a result, surfaces 302 define or help define firing position 90.

As seen in FIG. 4, a flat, transverse lower surface 304 of guide member 286 bears, when gun 12 is assembled, against upper surface 134 of chamber carrier rearward portion 106 and thereby confines chamber carrier assembly 58 to axial sliding movement in receiver housing 42. Formed axially through a lower portion 306 of guide member 286 is an aperture 308 which provides clearance for chamber carrier-mounted firing pin 140 (FIG. 2). Aperture 308 is shaped to conform to the contours of firing pin 140 when chamber carrier assembly 58 is fully forward in the battery position, walls defining the aperture thereby providing alignment and lateral support of the firing pin at the instant of shell firing. Axial length of guide member lower portion 306 is slightly less than the exposed length of firing pin 140 so that when chamber carrier assembly 58 is fully forward in its battery position, a rearward, transverse surface 310 of guide member lower portion 306 abuts a corresponding forward surface 312 of carrier assembly bracket 136 to which firing pin 140 is mounted (FIGS. 4 and 5). When chamber carrier assembly 58 is in the forwardmost battery position, a forward end of firing pin 140 necessarily projects forwardly from aperture 308 to enable firing of a shell 18 by the firing pin.

An upper portion 320 of guide member 286 extends rearwardly form rearward face 310 of lower portion so that, when rammer assembly 62 is fully forward in its battery position, a rearward face 322 of such upper portion abuts forward-facing surface 214 of rammer assembly rearward portion 186.

Extending upwardly from a flat, transverse upper surface 324 of guide member 286 are axially-spaced apart, forward and rearward, transverse lugs 326 and 328, respectively (FIG. 2). A U-shaped recess 330 is formed sidewardly (from the left-hand side of gun 12) into forward lug 326, a corresponding, U-shaped recess 332 being formed sidewardly into rearward lug 328. Recesses 330 and 332 are sized to receive a shell 18 with closed, arcuate ends of the recesses defining shell pickup position 258 (FIG. 2). Axial separation of lugs 326 and 328 is less than one shell length, but is selected to provide clearance for ammunition links 20 to pass therebetween so that the links can be ejected outwardly through an adjacent link ejection port 338 (FIG. 1) defined in housing 30.

Guide member 286 may, for example, as shown in FIG. 2, be retained in place in housing 42 by a plurality of machine screws 340 which extend through apertures 342 formed in housing side wall 264 and through apertures 344 formed through the guide member into threaded apertures (not shown) in housing left-hand side wall 266. Housing forward portion 40 is formed having a rearwardly extending portion 344, a forwardly extending portion 346 and a depending portion 348 (FIGS. 2, 4 and 5). A barrel receiving aperture 350 (FIGS. 4 and 5 extend axially through forwardly and rearwardly extending portions 344 and 346 along bore axis 82 (FIGS. 2, 4 and 5). A transverse, under surface 351 of rearwardly extending portion 344 is, upon assembly, coplanar with under surface 304 of guide member lower portion 306 and is forwardly aligned therewith. Surface 351 thereby provides a guide for upper surface 134 of chamber carrier assembly forward portion 104, retaining such forward portion in position. As previously described, rearward surface 292 of forward portion 40 (actually, of rearwardly extending portion 344 thereof) functions as a forward guide for chamber 56.

A transverse, rearward face 352 of depending portion 348 of housing forward portion 40 abuts forward surface 216 of chamber carrier assembly 58 and forward surface 200 of rammer assembly 62 when the rammer and carrier assemblies are in their respective forwardmost, battery positions. Accordingly, depending portion 348 of housing forward portion 40 functions as a forward stop for both chamber carrier and rammer assemblies 58 and 62.

Extending forwardly of depending portion 348, under forwardly extending portion 346, is a generally tubular chamber 354 which is preferably formed as part of rear barrel sight fitting 355, and which forms part of gas operating means 74. Extending axially through depending portion 348 and into chamber 354 is a cylindrical recess 356 (FIG. 4). Interconnecting a forward end of recess 356 with barrel bore 88, assuming barrel 34 is assembled to housing forward portion 40, is a narrow gas passageway 358, such passageway extending through a barrel side wall 360. Thus, when chamber 56 is in shell firing position 90 and a shell 18 held therein is fired, high pressure propellant gases are bled from barrel bore 88, through passageway 358 into forward regions of recess 356.

A gas operating piston 366 (FIGS. 2–4) is provided which has a forward, piston head 368 and a threaded rearward end 370. Upon assembly of gun 12, piston head 368 is received into chamber recess 356, a pair of annular seals 372 around the piston head providing a gas seal between the piston head and recess. Piston extends rearwardly from recess 356, threaded rearward end 370 thereof being received into a threaded recess 374 formed rearwardly, from forward face 200, into rammer assembly forward portion 182. A transverse pin 376, extending crosswise through rammer assembly forward portion 182 in the region of threaded recess 374 and into a slot 378 (FIG. 4) at the rearward end of piston 368, retains the piston in the threaded recess against accidental unthreading.

As is therefore evident, upon firing of gun 12, expanding high pressure barrel gas, diverted through passageway 358 into forward regions of recess 356, act on a forward face 380 of piston head 368, thereby pushing piston 366 rearwardly. Because of the above-described interconnection between piston 366 and rammer assembly 62, rearward movement of the piston, caused by the barrel gases, drives the rammer assembly rearwardly (direction of Arrow A) in recoil. Such rearward recoil movement of rammer assembly 62 causes simultaneous rearward recoil movement of chamber carrier assembly 58 by rearward facing surface 206 of rammer assembly forward portion 182 pushing against forward face 216 of the chamber carrier assembly.

Upon assembly to form receiver housing, 42, housing forward portion 40 is bolted between forward ends of side plates 264 and 266 by a plurality of machine screws 382 which extend through apertures 384 and 386 formed respectively through side plate 264 and housing forward portion 40, (FIG. 2). Preferably, as shown side plate 264 is formed having, towards its forward end, an inwardly projecting, narrow vertical rail 388. A Similar, inwardly projecting, vertical rail 390 is formed in the opposite side plate 266 towards such plate's forward end.

Housing forward portion 40 is formed having a vertical recess 392 into right-hand side 394 which, upon assembly of housing 42, receives right-hand side plate rail 388. In a similar manner, housing forward portion 42 is formed having in its left-hand side 396, a vertical recess 398 which, upon assembly of housing 42, receives rail 390 of left-hand side plate 266. Rails 388 and 390 in respective side plates 264 and 266 and corresponding recesses 392 and 398 formed in housing forward portion 40 provide positional stability of the housing forward portion relative to the housing side plates.

In a corresponding manner, inwardly facing, vertical recesses 404 and 406 (FIG. 2) are formed in respective housing side plates 264 and 266, rearwardly of rails 388 and 390, for receiving, upon assembly, respective sides 408 and 410 of link assembly block 150. Such side plate recesses 404 and 406 thus provide side edge confinement of link assembly 60 and provide guiding of the link assembly for its vertical sliding movement as chamber carrier assembly 58 is moved rearwardly or forwardly relative to the link assembly.

Rearwardly of recesses 404 and 406, inward facing vertical recesses 412 and 414 are formed into respective housing side plates 264 and 266 for receiving, upon gun assembly, sidewardly projecting rails 416 and 418 formed in forward regions of transverse block 286 (FIG. 2). Such block rails 416 and 418 and side plate recesses 412 and 414 provide positional stabilization of block 286 relative to side plates 264 and 266.

Inwardly facing, vertical recesses are additionally formed at rearward ends of side plates 264 and 266 to slidingly receive respective side edges 428 and 430 of housing rear plate 270. Recesses 426 and the corresponding recess in side plate 266 extend downwardly from upper edges 434 and 433 of side plates 266 and 264, but do not extend entirely to the bottom of the side plates; accordingly, closed lower ends of the side plate recesses serve as stops for rear plate 270 when such plate is installed downwardly into the recesses.

Elongate, inwardly facing grooves or recesses 440 and 442 (FIGS. 2, 6 or 7) are formed along lower edge regions of respective housing side plates 26 for receiving, upon assembly, longitudinally extending and outwardly projecting side edge regions 444 and 446 of bottom plate 268. During firing operation of gun 12, lower surface 272 of rammer assembly 62 and lower surface 274 and 276 of chamber carrier assembly 58 slide along upper surface 278 of housing bottom plate 268.

Buffer means 66 are mounted to housing rear plate 270 rearwardly of and in axial alignment with, rammer assembly 62 and chamber carrier assembly 58 (FIG. 4). Comprising buffer means 66 are a housing 448 containing a number of respective outer and inner ring springs 450 and 452, as are well known in the gun art. Housing 448 comprises a forward buffer housing portion 454, which projects forwardly through an aperture 456 formed through rear plate 270, and a rearward buffer housing portion 458 which is joined, at a forward end to rear plate 270. Buffer housing forward portion 454 and ring springs 450 and 452 are installed into buffer housing rearward portion 458 through a detachable buffer housing end cap 464 which is threaded into the rearward end of buffer rearward housing portion. Buffer housing forward portion 454 is retained in rearward housing portion by an annular flange 472 formed around outer, rearward regions of such forward portion.

In response to a forward face 474 of buffer housing forward portion 454 being impacted by respective rearward faces 476 and 478 of rammer assembly 62 and chamber carrier assembly 58, as such assemblies are recoiled rearwardly in response to firing of gun, the buffer housing forward portion is driven rearwardly into buffer housing rearward portion 458. As housing forward portion 454 is driven rearwardly into rearward portion 458, ramping action between outer and inner ring springs 450 and 452 causes the outer rings to expand radially and the inner springs to contract radially, rearward recoil energy of rammer and chamber carrier assemblies 62 and 58 being thereby absorbed and recoiling of the rammer and carrier assemblies being thereby stopped in a very short distance after buffer impact.

Reference is made herein to the "rearwardmost positions" of rammer assembly and chamber carrier assembly 58. As used herein in such content, the term "rearwardmost" is used in a general sense and may be considered to be the rearward position of the rammer assembly 62 and chamber carrier assembly 58 at the point of buffer impact or at the slightly more rearward position at which rearward movement of the assemblies actually stops due to buffer action. It may be appreciated that whereas the rearward point of buffer contact remains constant, the slightly more rearward point of actual stopping of rammer and chamber assemblies 62 and 58 may vary according to recoil velocity, buffer ambient temperature, ring spring characteristics and other related factors.

In automatic firing of gun 12 rammer and chamber carrier assemblies 62 and 58 are required after their recoil movement is stopped by buffer means 66, to move back forwardly to their respective forwardmost, battery positions. Although some forward moving force is provided to rammer assembly 62, chamber carrier assembly 58 is, as discussed below, always seared up as it leaves buffer means 66, even if the rammer assembly is not seared up. Principal forward driving of rammer assembly 62 and entire forward driving of chamber carrier assembly 58 (upon its unsearing) is provided by driving means 64.

Comprising driving means 64 are elongate, rammer assembly drive spring 480 and spring rod 482 and elongate chamber carrier assembly drive spring 484 and spring rod 486 (FIGS. 2–7). Rammer assembly and chamber carrier spring rods 482 and 484 are fixed at their rearward ends, by respective pins 488 and 490, to a drive spring mounting plate 492 (FIG. 4). In turn, mounting plate 492 is mounted, as by screws, not shown, to a forward surface 494 of housing rear plate 276, in the region of buffer housing portion 456. A generally inverted "U"-shaped cutout 496 is provided in buffer housing forward portion 456 to provide clearance for drive spring mounting plate (FIGS. 2 and 3).

Forward regions of drive spring support rods 484 and 486 and of drive springs 480 and 482, which are mounted on the support rods, are received into respective elongate, cylindrical apertures 146 and 498 formed, longitudinally through rammer assembly 62 and aperture aperture 500 formed through chamber carrier assembly 58. Shoulders 502 and 504 formed adjacent forward ends of respective apertures 498 and 500 retain forward ends of drive springs 480 and 482 in such apertures, but permit support rods 484 and 486 to extend forwardly through the apertures when rammer and chamber carrier assemblies 62 and 58 are rearwardly, of their forwardmost, battery positions. Accordingly, drive springs 480 and 482 are compressed whenever rammer and chamber carrier assemblies 62 and 58 are moved rearwardly from their battery positions and thereby provide power for driving the rammer and carrier assemblies back forwardly to their battery positions.

Searing means 68 provide two stage, or primary and secondary searing of rammer assembly 62 and chamber carrier assembly 58. Thus, as shown in FIGS. 2 and 3, searing means 68 comprise a primary, rammer sear 514 and a split, secondary, chamber carrier sear 516. Both primary and secondary sears 514 and 516 are mounted on a common transverse pivot pin 518 which also extends through side plates 26 and 266, there being shown an aperture 520 through housing right-hand side plate 264, near a bottom edge 522 thereof and slightly rearwardly of a plane through rearward surface 292 of barrel 34.

Primary and secondary sears 514 and 516 are mounted on pivot pin 518, with the primary sear disposed between the split sections of the secondary sear. As shown in FIGS. 2–5, sears 514 and 516 are generally "tear drop" shaped, with pivot pin 518 extending through larger, forward regions thereof so that the slender, tapered regions thereof are normally rearwardly and upwardly directed. Primary sear 514 is shaped and directed so that when rammer assembly 62 leaves buffer assembly 66 in counterrecoil, and triggering means 70 are released, as described below, a rearwardly facing surface 524 of primary sear 514 engages a forwardly facing step 526 (FIG. 5) formed transversely across the bottom of rammer assembly 62 at the intersection or transition between rammer assembly forward and intermediate portions 182 and 184 and thereby sears up the rammer assembly. Secondary sear 516 is shaped and directed so that whenever chamber carrier assembly 58 leaves buffer assembly 66 in counterrecoil, a rearwardly facing surface 528 of the secondary sear engages beveled surface regions 530 (FIGS. 2 and 3) located at forward, lower regions of chamber carrier legs 108 and 110.

Both sears 514 and 516 are shaped and mounted so that they deflect out of the way as rammer assembly 62 and chamber carrier assembly 58 recoil or travel rearwardly from their forwardmost, battery positions to their rearward, searing up positions.

In general, the rearward, searing up positions of rammer and chamber carrier assemblies 62 and 58 may be considered to be at the rearwardmost positions of travel thereof, although, in recoil after firing of gun 12, the rammer and chamber carrier assemblies may travel slightly past the searing up position as they are brought to a stop by buffer springs 450 and 452. Thus the term "rearwardmost position" as used therein should be considered as encompassing a small range of rearward portions between the recoil stopping positions which may vary according to gun condition and recoil velocity, and the fixed searing up position.

Operation of primary sear 514 is enabled by an upwardly projecting ear 532 of such sear, the ear being pivotally connected, by a transverse pivot pin 534, to a forward end of an elongate trigger link or bar 536. A rearward end of trigger link is formed having a "U"-shaped recess or socket 538 (FIG. 4) into which is received a lower, ball-shaped end 540 of a trigger member 542 which is shaped to fit around buffer assembly 66, rearwardly of end plate 270. Transverse pivot pins 544 pivotally mount opposite side regions of trigger member 542 to buffer housing rearward portion 448 (FIG. 1). Upper end regions 546 of trigger member 542 extends upwardly and rearwardly to a central, thumb-engaging position located between and forwardly of a pair of generally conventionally shaped hand grips 548 which are mounted to receiver end plate 270 and extend rearwardly thereof. (FIGS. 1 and 4).

One or more trigger springs 50 urge trigger member upper end regions 546 rearwardly to a non-firing position and thereby, through link 536, urge primary sear 514 to an upward, rammer searing position. Thus, when trigger member 542 is released by the gun operator and rammer assembly 62 is moved rearwardly to the rearwardmost, searing position, the rammer assembly is automatically seared up by primary searing means 514. Subsequent, forward pressing of trigger member upper end region 546 causes, through link 536, the downward pivoting of primary sear 514 to thereby unsear rammer assembly 62. So long as trigger upper end region 546 is kept depressed, rammer assembly 62 will cycle with each firing of gun 12 without searing interruption. To provide clearance for trigger link 536, a longitudinal groove 552 (FIG. 7) is formed upwardly into the bottom of rammer assembly 62.

Secondary, chamber carrier sear 516 is normally maintained in its searing position by spring means 558 which act on the sear through first and second identical, laterally spaced apart links 560 and 562, respectively (FIGS. 2 and 3). The rearward end of first link 560 is pivotally mounted, by a transverse pin 564 to an ear 566 which projects downwardly from the pivot point of the right-hand portion of secondary sear 516. The rearward end of second link 562 is similarly pivotally connected to an ear, corresponding to ear 566, of the left-hand portion of the secondary sear. Forwardly extending ends of links 560 and 562 are pivotally mounted in rearwardly-opening recesses 568 formed in a rectangular block 570 which forms a part of spring means 558. Rearward end regions of first and second compression-type springs 580 and 582 are received in respective cylindrical first and second recesses 584 and 586 formed rearwardly into block 570.

As shown in FIG. 5, spring means 558 are transversely disposed in receiver housing 42 so as to be beneath rammer assembly forward portion when rammer assembly 62 is in its forwardmost, battery position. A lower surface 588 of block 570 rests on an upper surface 590 of a transverse lip 592 formed atthe forward end of bottom plate 268. Forward ends of springs 580 and 582 bear against lower regions of housing forward portion surface 352 and urge a block 570 rearwardly, thereby pushing links 560 and 562 rearwardly to cause secondary sear 516 to pivot clockwise (direction of Arrow C, FIGS. 4–5). Assuming chamber carrier assembly 58 is rearwardly of sear 516, the carrier assembly will then be seared up. Springs 580 and 582 permit secondary sear 516 to pivot downwardly (direction of Arrow C') as chamber carrier assembly passes over the sear. A small cover or housing 598, is detachably connected to bottom plate 268 for covering searing means 68.

Secondary sear spring block 570 is located relative to rammer assembly 62, and both are mutually configured, so that as the rammer assembly moves forwardly into close proximity to its forwardmost, battery position, rammer assembly stepped surface 526 (which is, as above described, engaged by primary sear 514 to sear up the rammer assembly) engages upper regions of spring block rearward surface 594. Continued forward movement of rammer assembly 58 the short distance required to reach the battery position pushes spring block 570 forwardly, against springs 580 and 582, thereby causing links 560 and 562 to pivot secondary sear 516 counterclockwise downwardly (direction of Arrow C') to its unseared position and thereby unsearing chamber carrier assembly was seared up. Thus, forward movement of rammer assembly 62 into its battery position automatically triggers the unsearing of chamber carrier assembly 58. Conversely, whenever chamber carrier assembly 58 moves forwardly to its searing up position, it will be automatically seared up by secondary sear 516 so long as rammer assembly 62 is not its forwardmost battery position, which should never be the case.

The above described searing of chamber carrier assembly 62, by secondary sear 516 causes the carrier assembly to remain seared up, with chamber 56 correspondingly constrained to shell loading position 84, until rammer assembly 62 has moved fully forwardly and has, thereby, completed the loading of a shell into chamber aperture 86. Chamber carrier assembly 62 is then unseared, and is driven forwardly by spring 484, there causing chamber 56 to be moved to firing position 90 and causing firing of a shell 18 held in the chamber when the carrier assembly reaches battery.

Shell feeding and casing ejecting means 72 are configured and operative, in part, for serially feeding shells 18 into shell pickup position 258; more particularly, for advancing ammunition belt 20 one shell position at a time. Operation of shell feeding and casing ejecting means 72 is coordinated with movement of chamber 56 and rammer assembly 62 so that a shell 18 is advanced into shell pickup position the chamber is moved into shell loading position 84 and as the rammer assembly is moved rearwardly to its searing up position Shell feeding and casing ejecting means 72 are, moreover, configured and operative for ejecting shell casings 18*a* from shell ejecting position 260, outwardly through ejection port 262, contemporaneously with the moving of a shell 18 into pickup position 258.

Comprising shell feeding and casing ejecting means 72 are a drive rack gear 608, a drive pinion gear 610 and, feeding gear 612 and ejecting gear 614, (FIGS. 3, 4, and 7). Drive pinion, feeding and ejecting gears 608, 610 and 612 are fixed, in a longitudinally spaced relationship, onto a gear shaft 616 which is journaled for rotation, about a longitudinal axis 618, in respective rearward and forward bearings 620 and 622 mounted in a feeder housing 624 (FIG. 4). Orientation of gear shaft 616 is such that shaft axis 618 is parallel, but offset above, barrel bore axis 82.

Drive rack gear 608, in the shape of a elongate bar having a square or rectangular cross section, is slidingly mounted in a rectangular feeder housing boss 626 (FIGS. 4–7) for up and down sliding movement in the direction of Arrows B—B', that is, in the same direction as movement of connecting link assembly 60. A compression spring 628 (FIGS. 3, 4 and 7) is installed within housing boss 626 above rack gear 608, a lower end of rack spring pushing downwardly against an upper surface 630 of the rack gear.

Housing boss 626 is positioned so that when spring 628 and rack gear 608 are installed thereinto, a lower surface 632 of the rack gear bears against an upper surface 634 of connecting link block 150 (FIGS. 3 and 7). As a consequence, rack gear 608 is caused to move up and down (directions of Arrows B—B') in unison with up and down movement of connecting link assembly 60. Contact is caused to be maintained between rack gear 608 and connecting link assembly 60 by spring 628

Gear shaft 616 is mounted orthogonally with respect to direction of movement of rack gear 608 so that drive pinion gear 610 is in driven engagement with an outwardly facing gear surface 636 of the rack gear. Thus, as shown in FIG. 3, upward movement of rack gear 608 (direction of Arrow B) caused by upward movement of link assembly 60 to move chamber 56 from shell firing position 90 into shell loading position 84, causes counterclockwise rotation of drive pinion gear 610 and, consequently, of gear shaft 616 (direction of Arrow D). Subsequent downward movement of rack gear 608 (direction of Arrow B''), responsive to movement of chamber 66 from loading position 84 back to firing position 90, causes clockwise rotation of pinion gear 610 and gear shaft 616 (Direction of Arrow D'').

Mounted in feeder housing 624 is a shell feeding slide 642 which has a feeding rack gear 644 formed along an upper surface 646. (FIGS. 3 and 6). Slide 642 is mounted in housing 624 for transverse sliding movement in a direction (Arrows E—E' orthogonal to the direction of travel of drive rack gear 608 and with feeding rack gear 644 in driven engagement with first gear 612. As a result, when drive rack 608 is moved upwardly (direction of Arrow B) in response to the moving of chamber 56 to shell feeding position 84, feed slide 642 is caused (by gear 612 through gear 610) to move inwardly, towards bore axis 82 (direction of Arrow E). Subsequent, downward movement of drive rack gear 608 (direction of Arrow B') causes shell feed slide 642 to move back outwardly (direction of Arrow E').

One (or more) feed pawls 648 are pivotally mounted to undersides of feed slide 642 by a pivot pin 650 (FIG. 6). A spring (not shown) urges feed pawl 648 to a normal, shell feeding position in which the pawl extends downwardly and inwardly (towards barrel bore axis 82) to a normal, shell feeding position in which a free end of the pawl engages an endmost one of belt links 20. Inward movement of feed slide 642 (direction of Arrow E), responsive to upward movement of drive rack gear 608 as chamber 56 is moved to shell loading position 84, causes pawl 648 to push against belt link 20 in a manner advancing ammunition belt 16. Gears 610 and 612 are sized so that the upward movement of rack gear 608, responsive to movement of chamber 56 from shell firing position 90 to shell loading position 84 causes shell feed slide 642 to advance ammunition belt 16 one shell position, so as to move a shell 18 into shell pickup position 258.

As shell feed slide 642 is subsequently returned to its outermost position shown in FIG. 3. Pawl 648 retracts (direction of Arrow F) to permit the slide to move over shells 16. Spring loaded, shell anti-back-up pawls (not shown) are provided below pawl 648 and under ammunition belt 16 to prevent the belt from backing out of gun 12, when slide 642 is moved outwardly. The region immediately below shell feed slide 642 through which ammunition belt 16 travels during shell feeding defines a shell in feed port 652 (FIG. 6).

When a shell in pickup position 258 is moved forwardly, by rammer portion 92, out of endmost belt link 20, the link becomes disengaged from belt 16. The subsequent advancing, by slide 642 of a next shell 18 into pickup position 258 pushes the disengaged belt link 20 out of gun 12 through link ejection port 338.

A casing ejection slide 658 (FIGS. 3 and 4), included in shell feeding and casing ejecting means 72, has a rack gear 660 formed along the upper surface thereof and is generally similar to shell feed slide 642. Casing ejection slide 658 is mounted in housing 624 to be in driven engagement with gear 614 and for lateral sliding movement in the direction of Arrows E—E'. Pivotally mounted to ejection slide 658, by a pin 662, is a spring loaded pawl 664, (FIG. 3), similar to shell advancing pawl 648, described above, which projects inwardly and downwardly below the ejection slide. Responsive to upward movement of link assembly 60, when chamber 56 is moved from shell firing position 90 into shell loading position 84, casing ejection slide 658 is moved inwardly (direction of Arrow E), pawl 664 thereby pushing a shell casing 16*a* positioned in shell ejection position 260 out of gun 12 through ejection port 262 (FIG. 1).

Subsequently, as chamber carrier assembly 58 moves forwardly and chamber 56 is moved back down to firing position 90, ejection slide 658 is moved back outwardly (by downward movement of rack gear 608), pawl 664 retracting as it passes over a next casing 18*a* just moved into ejection position 260.

Shell feeding and casing ejection slides 642 and 658 are slidably mounted in feeding and ejecting means housing 624, for example, by side rails 666 on slide 642 and side rails 668 on slide 658 (FIG. 4 ) which fit into mating recesses 670 and 672 of housing 624. As a result, when housing 624 is povited open relative to gun, about a transverse, forward pivot pin 674, all of the above-described shell feeding and casing ejecting mechanism is pivoted upwardly and forwardly away from gun receiver 42. Drive rack gear 608 is retained in housing 624 by stops (not shown) so that when the housing is opened, the rack gear does not fall out.

Shown associated with shell feeding and casing ejecting means 72 and pivotally mounted to housing 624 by a transverse pivot pin 676 (FIG. 4 ) is a shell retaining element 678. Such element 678 is, as shown, spring loaded to a position in which a lower end 680 of the element projects downwardly in front of upper regions of shell loading position 84. When chamber 56 is in shell loading position 84, element 678 functions to retain a shell 18 in chamber aperture 88 against accidental forward movement of the shell out of the aperture. Spring loading of element 678, however, permits a casing 18*a* to be pushed forwardly out of chamber aperture 88 when a shell 18 is loaded thereinto by rammer portion 92.

Latching means 688 (FIGS. 2 and 4) are provided as part of receiver housing 42 for locking shell feeding and casing ejecting means housing 624 in the closed condition shown in FIG. 4 and for locking housing rearward end plate 270 in position. Latching means 688 comprises a latch housing 690 having sidewardly projecting side edge rails 692 which slidingly engage corresponding longitudinal recesses (not shown) formed in upper, rearward regions of housing side plates 264 and 266 so that latch housing slides forwardly between the side plates into rearward engagement with feeding and ejecting means housing 624.

Included in latching means 688 are forward and rearward spring-loaded pins 694 and 696. When assembled, a forward end of forward pin 694 is received into a recess 698 of feeding and ejection means housing 624 to maintain such housing closed. Also when assembled, a rearward end of rearward pin 696 is received into a recess 700 by receiver housing rear plate 270 to retain such plate in a downwardly installed position exposed operating buttons 702 and 704 connected to pins 694 and 696, respectively, enable individual retraction of the pins to enable pivoting open of feeding and ejection means 72 and removal of rear housing plate 220.

Gun charging means 710, (FIG. 1), which include a foldable handle 712, are connected through side plate 464 to rammer assembly 62 so that the rammer assembly and carrier assembly 58 can be manually pulled back from their forwardmost positions to their seared up positions for searing up by searing means 68.

OPERATION

Although operation of gun 12 has been generally described above in conjunction with description of the gun, such operation is pictorially depicted, in a time sequence manner, in FIG. 8. Gun 12, and more particularly inner portions of receiver assembly 30, are depicted at an instant, $t_o$, of firing of a shell 18 held in chamber assembly 56, projectile 21 being shown still in barrel 34 and casing 18*a* being shown in chamber aperture 88. At the instant, $t_o$, of firing, rammer assembly 62 is fully forward in its battery position, and rammer portion 92 thereof having, as the rammer assembly moved forwardly, rammed the just fired shell 18 into chamber aperture 88. Chamber carrier assembly 58 is also fully forwardly in its battery position at the instant, $t_o$, of firing, the carrier assembly mounted firing pin 140 having caused firing of the shell 18 held in chamber aperture 88 as the carrier assembly closely approaches the battery position. As above described, forward movement of chamber carrier assembly 58 (after shell loading by rammer assembly 62) moves chamber assembly 56 downwardly from shell loading position 84 to the shell firing position shown in which chamber aperture 88 is axially aligned with barrel bore axis 82.

In response to the firing of a shell 18, barrel gases are bled from barrel 34 through passageway 358 into piston chamber 356 These high pressure barrel gases drive gas piston 366 rearwardly (FIG. 8*b*) thereby driving rammer assembly 62 rearwardly in recoil towards buffer 66. In turn, such rearward recoiling of rammer assembly 62 pushes chamber carrier assembly 58 rearwardly in recoil. As chamber carrier assembly 58 moves rearward, chamber assembly 56 is pushed back upwardly to shell loading position 84. At the same time, a next shell 18 is moved into shell feeding position 258 by shell feeding and casing ejecting means 72. Also at the same time, a fired shell casing 18*a* in casing ejecting position 260 is ejected from gun 12.

Figure 8A:
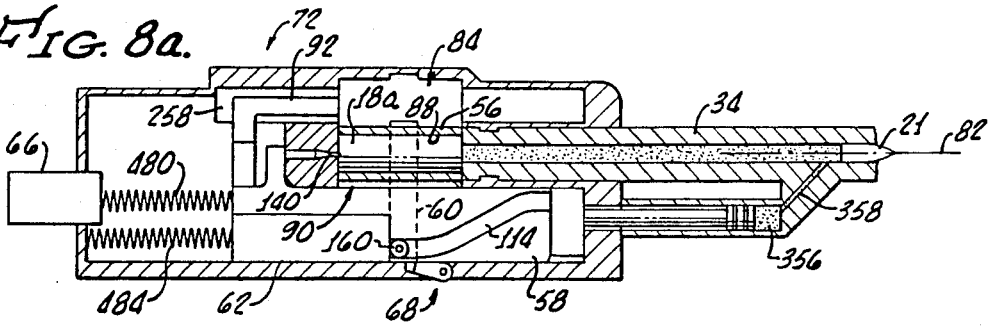
FIG. 8 is a time sequence diagram showing loading and firing operation of the exemplary machine gun shown in the previous FIGS.
Figure 8B:
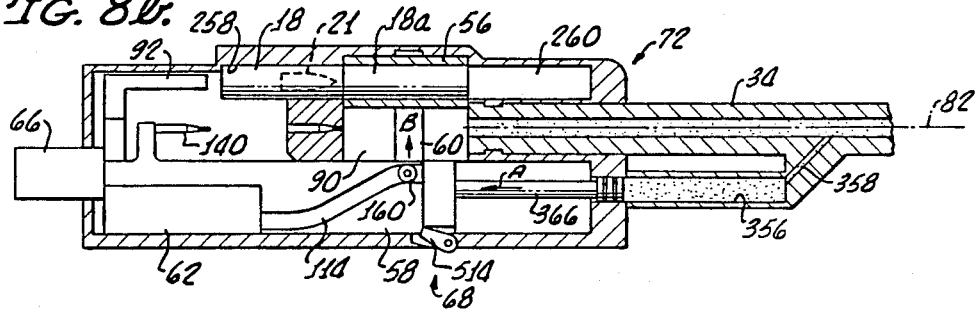
Figure 8C:
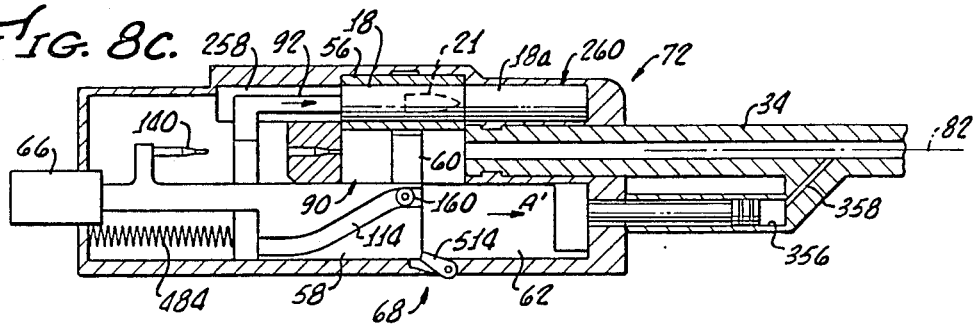
Figure 8D:
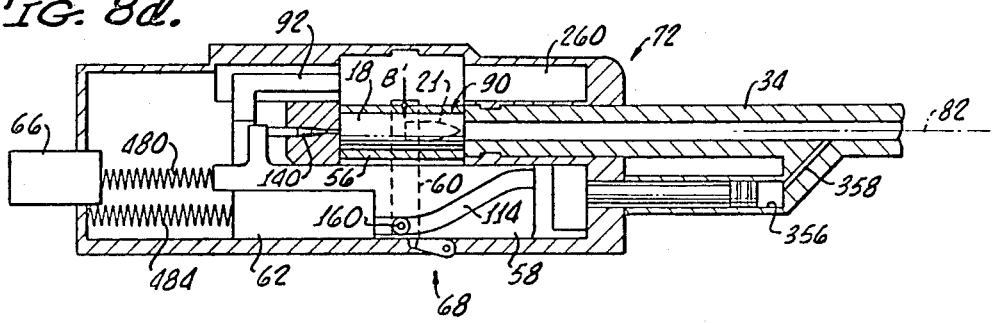

At the time, $t_1$, to which FIG. 8*b* corresponds both chamber carrier assembly 62 and rammer assembly 62 are fully rearwardly in their searing-up positions, respective drive springs 480 and 484 being in their maximum compressed condition. At the rearwardmost positions depicted in FIG. 8*b*, chamber carrier assembly 58 is automatically seared up by secondary sear 516 (not shown) of searing means 68. If firing is to be interrupted (by release of trigger member 542, not shown), rammer assembly 62 is seared up, as shown in FIG. 8*b*, by primary sear 514. If firing is to be sustained, rammer assembly 62 is not seared up. If rammer assembly 62 is, in fact, seared up, gun 12 is, as depicted in FIG. 8*b*, in readiness for a next shell firing.

When rammer assembly 62 is unseared, and is pushed forwardly by drive spring 480, rammer portion 92 rams shell 18 from feeding position 258 forwardly into chamber aperture 88, thereby pushing casing 18*a* forwardly from the chamber aperture into casing ejecting position 260. When, at time, $t_2$, rammer assembly 62 reaches its forwardmost battery position depicted in FIG. 8*c*, chamber carrier assembly 58 is caused to be unseared so that it can be driven forwardly by drive spring 484.

An instant later, at time, $t_3$, (FIG. 8*d*) chamber carrier assembly 58 has been driven forwardly nearly to its forwardmost, battery position, loaded chamber assembly 56 having been thereby moved back downwardly to the firing position in which a shell 16 in chamber aperture 88 is aligned with barrel 34. At the time, $t_3$, firing pin 140 is rearwardly adjacent shell 16 and is about to cause firing thereof.

By way of example, with no limitations intended or implied, for a typical machine gun firing rate of 750 rounds per minute, having a corresponding cycling time of 90 msec, $t_1$ (FIG. 8*b*) is about 25 msec, $t_2$ (FIG. 8*c*) is about 40 msec and $t_3$ is about 78 msec. Different times will, of course, be associated with different firing rates.

Because of its manner of construction to utilize telescoped shells 18, it is estimated that gun 12 will be about 30 percent higher than counterpart, conventional guns of the same calibre, with the length of receiver assembly 30 being estimated as being only about 50 percent as long as receivers of such conventional guns of the same calibre. Moreover, it is estimated that from aft of shell loading and casing feeding means 72, gun 12 is only about one third as long as counterpart conventional guns of the same calibre.

The expected weight advantages of gun 12 are particularly important for manually carried weapons and the size advantages are particularly important when the gun is mounted in closely confined areas such as gun turrets.

Although there has been described above a specific arrangement of a gun configured for firing telescoped ammunition in accordance with the present invention for purposes of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the appended claims.

What is claimed is:

1. A gun for firing cylindrically-shaped, telescoped ammunition, the gun comprising:

(a) a receiver;

(b) a gun barrel and means detachably connecting rearward end regions of the barrel to forward regions of the receiver;

(c) a shell chamber having formed longitudinally therethrough a cylindrical, shell-holding aperture sized to receive a cylindrical, telescoped shell and means mounting the shell chamber in the receiver rearwardly of the barrel for linear sliding movement in a direction orthogonal to a bore axis of the barrel between a shell-loading position in which the shell-holding aperture is out of axial alignment with the bore through the barrel and a shell firing position in which the shell-holding aperture is axially aligned with the barrel bore;

(d) a shell chamber carrier and means mounting the carrier in the receiver for axial sliding movement between a forwardmost, battery position and a rearwardmost position;

(e) means for interconnecting the chamber with the shell chamber carrier so as to cause the shell chamber to be in the shell loading position when the shell chamber carrier is in the rearwardmost position and to be in the shell firing position when the shell carrier is in the forwardmost, battery position;

said interconnecting means including means defining a cam track on the shell chamber carrier and including an interconnecting link, the interconnecting link being connected to the shell chamber and having a cam track follower engaging said cam track; and said cam track being a generally "S"-shaped recess formed along the shell chamber carrier, and said cam track follower comprising a roller sized to roll along said cam track;

(f) means for causing movement of the shell chamber carrier between the forwardmost, battery position and the rearwardmost position;

(g) means for loading a shell into the shell-holding aperture when the shell chamber is in the shell loading position;

said loading means including shell feeding means for moving a shell into a pickup position rearwardly of said shell loading position and further including shell rammer means for ramming shells forwardly from the pickup position into the shell-holding aperture when the shell chamber is in the shell loading position;

said shell rammer means including a rammer body having a forwardly extending shell rammer fixed thereto and including means mounting the shell rammer means in the receiver for axial sliding movement between a rearwardmost position in which the shell rammer is rearward of a shell in a said pickup position and a forwardmost, battery position in which the shell rammer is rearwardly adjacent the shell chamber when the shell chamber is in the shell loading position and further including means for causing movement of the shell rammer means between the rearwardmost and forwardmost, battery positions;

(h) means for causing firing of a shell held in the shell-holding aperture when the chamber is in the shell-firing position; and, (i) sear means for searing up the shell chamber carrier and the rammer means when the shell chamber carrier and the shell rammer means are in their rearwardmost positions and including means for releasing said searing means so as to release the shell rammer means and shell chamber carrier for forward movement thereof.

2. The gun as claimed in claim 1 wherein the searing means include a primary sear for searing up the shell rammer means and a secondary sear for searing up the shell chamber carrier.

3. The gun as claimed in claim 2 wherein the sear releasing means include triggering means connected for selectively releasing the primary sear and means responsive to forward movement of the shell rammer means to its forwardmost battery position for causing release of the secondary sear.

4. The gun as claimed in claim 3 wherein the searing means are configured for causing the secondary sear to sear up the shell chamber carrier whenever the shell chamber carrier is moved rearwardly to its said rearwardmost position provided the shell rammer means is not at its said forwardmost, battery position and irrespective of whether or not the triggering means causes the primary sear to sear up the shell rammer means.

5. A gun for firing cylindrically-shaped, telescoped shell of substantially uniform diameter and length, the gun comprising:

(a) a receiver having means defining a shell feeding port and a fired shell casing ejection port, adjacent ends of said shell feeding and casing ejection ports being longitudinally spaced apart a distance equal to at least about the length of one of the shells fired by the gun, said receiver further including means defining a shell ramming position in shell transfer communication with the shell feeding port and means defining a fired shell casing discharge position in shell casing transfer communication with the shell ejection port, said shell ramming position and said shell casing discharge position being axially aligned;

(b) a gun barrel having a bore axis; and means for detachably connecting a rearward end region of the barrel to forward regions of the receiver, with said bore axis of the gun barrel laterally offset from the axially aligned shell ramming and shell casing discharging positions;

(c) a shell chamber having means defining a cylindrical shell-holding aperture sized to hold one of said cylindrically-shaped, telescoped shells to be fired by the gun;

(d) means for mounting the shell chamber in the receiver intermediate the shell feeding and casing ejection ports for lateral movement between a shell loading position in which the shell holding aperture is between, and is axially aligned with, the shell ramming and fired casing discharging positions and a shell firing position in which the shell-holding aperture is axially aligned with the barrel;

(e) means for causing movement of the shell chamber between the shell loading and the shell firing positions;

said movement causing means including a shell chamber carrier, means for mounting the shell chamber carrier in the receiver for axial sliding movement between a forwardmost, battery position and a rearwardmost position, including means for interconnecting the shell chamber carrier and the shell chamber so as to cause the shell chamber to be in the shell firing position when the shell chamber carrier is in the battery position and so as to cause the shell chamber to be in the shell loading position when the shell chamber carrier is in the rearwardmost position, and further including means for causing the shell chamber carrier to move between the battery position and the rearwardmost position;

said movement causing means further including gas operated piston means connected for receiving pressurized barrel gases caused by firing of a shell held in the shell chamber shell-holding aperture when the shell chamber is in the shell firing position and for causing, in response to receiving said pressurized gases, recoil movement of the shell chamber carrier from the battery position to the rearwardmost position, and further including drive spring means connected for causing counterrecoil movement of the shell chamber carrier from the rearwardmost position to the battery position;

(f) means for ramming a shell from the shell ramming position into the shell chamber shell-holding aperture when the shell chamber is in the shell loading position, thereby also causing a fired shell casing held in the shell chamber shell-holding aperture to be pushed out therefrom into the fired casing discharge position;

said shell ramming means including a rammer body having an elongate shell rammer mounted thereto and means for mounting the rammer body in the receiver for axial sliding movement between a first position in which the shell rammer is out of engagement with a shell in the shell ramming position and a second position in which the shell rammer has pushed a shell from the shell ramming position fully into the shell chamber shell-holding aperture and including means for moving the shell rammer body between the first and second positions, said shell rammer body moving means cooperating with the shell chamber moving means so that the shell chamber carrier is in its rearwardmost position, with the shell chamber in the shell loading position, when the rammer body is moved from the first position to the second position;

(g) means for firing a shell held in the shell chamber shell holding aperture when the shell chamber is in the shell firing position;

said shell firing means including a firing pin connected to the shell chamber carrier in a position causing the firing pin to impact and fire a shell held in the shell chamber shell-holding aperture when the shell chamber carrier moves forwardly into the battery position thereby causing the shell chamber to be moved into the shell firing position; and (h) searing means for searing up the shell chamber carrier when the shell chamber carrier is in its rearwardmost position and for searing up the rammer body when the rammer body is in the first position.

6. The gun as claimed in claim 5 including sear control means for enabling the unsearing of the rammer body and enabling the rammer body to be moved by the rammer body moving means from the first position to the second position before the shell chamber carrier is unseared.

7. The gun as claimed in claim 6 wherein the sear control means include shell chamber carrier unsearing means responsive to the rammer body being moved to said second position for unsearing the shell chamber carrier.

8. A self-powered, automatic gun for firing cylindrically shaped, telescoped shells of substantially uniform diameter and length held in a link-type ammunition belt, the gun comprising:

(a) a receiver having defined therein an ammunition belt feed port, a fired shell casing ejection port, a belt link ejection port, a shell pickup position in communication with the feed port and the belt link ejection port, and a casing discharge position in communication with the casing ejection port, the shell pickup position and the casing discharge positions being axially aligned and spaced apart about one shell length;

(b) a gun barrel and means for connecting a rearward end of the barrel to forward regions of the receiver;

(c) a shell chamber having defined therethrough a longitudinal shell-holding aperture sized to enable the sliding therethrough of said cylindrical-shaped, telescoped shells and having a length substantially equal to the length of one of said shells;

(d) means for mounting the shell chamber in the receiver rearwardly of the rearward end of the gun barrel for sliding movement between a shell firing position in which the shell-holding aperture is aligned with the gun barrel and a shell holding position in which the shell holding aperture is clear of said gun barrel and is between and is axially aligned with the shell pickup position and the casing discharge position;

(e) a shell chamber carrier and means mounting the shell chamber carrier in the receiver for axial sliding movement between a forwardmost, battery position and a rearwardmost position;

(f) means interconnecting the shell chamber with the shell chamber carrier so as to cause the shell chamber to move from the shell firing position to the shell loading position in response to the shell chamber carrier moving from the forwardmost position to the rearwardmost position and for causing the shell chamber to move from the shell loading position to the shell firing position in response to the shell chamber carrier moving from the rearwardmost position to the forwardmost position;

(g) shell feeding means responsive to movement of the shell chamber to the shell loading position for advancing the ammunition belt through the belt feed port so as to position a shell held in the belt in the shell pickup position and for moving a shell casing in the casing discharge position out of the casing ejection port;

(h) shell rammer means for loading shells into the shell chamber shell-holding aperture when the shell chamber is in the shell loading position, said shell rammer means including a rammer body having mounted thereto a shell rammer member and means for mounting the rammer body in the receiver for axial sliding movement between a forwardmost rammer position and a rearwardmost rammer position, movement of the rammer body from the rearwardmost rammer position to the forwardmost rammer position, when a shell is in the shell pickup position and the shell chamber is in the shell loading position, causing a shell to be rammed from the pickup position into the shell chamber shell-holding aperture, thereby causing a shell casing held in the shell chamber shell-holding aperture to be rammed out of said aperture into the casing discharge position;

(i) means responsive to firing of a shell held in the shell chamber shell-holding aperture for causing movement of the shell chamber carrier and the shell rammer means from their said forwardmost positions to their said rearwardmost positions;

(j) means, when the shell chamber carrier and the shell rammer means are in their rearwardmost positions, for preventing forward movement of the shell chamber carrier until the shell rammer means has moved forwardly to its forwardmost rammer position, thereby enabling the loading of a shell into the shell chamber shell-holding aperture before the shell chamber carrier starts moving forwardly to its forwardmost battery position and the shell chamber starts moving from the shell loading position to the shell firing position;

(k) means for causing firing of a shell held in the shell-holding aperture when the shell is in the shell firing position;

(i) means for searing up the shell rammer means when the shell rammer means is in its rearwardmost position; and (m) means for unsearing the shell rammer means when the shell rammer means is seared up.

9. The automatic gun as claimed in claim 8 wherein the means for moving the shell rammer means and the shell chamber carrier between their said forwardmost and rearwardmost positions comprise a barrel gas cylinder in gas flow communication with the barrel bore and a piston disposed in said cylinder, said barrel gas cylinder and piston being located so that the piston is in rearward pushing engagement with at least one of the shell rammer means and the shell chamber carrier so as to cause rearward movement thereof in response to pressurized barrel gases caused by firing of the gun flowing into said cylinder.

10. The automatic gun as claimed in claim 9 wherein the piston is in rearward pushing engagement with the shell rammer means, and wherein the shell rammer means include means for pushing the shell chamber carrier rearwardly when the shell rammer means is pushed rearwardly by said piston.

11. The automatic gun as claimed in claim 9 wherein the means for moving the shell rammer means and the shell chamber carrier between their said forwardmost and rearwardmost positions include a first forward drive spring connected between the receiver and the shell rammer means and a second forward drive spring connected between the receiver and the shell chamber carrier, said first and second drive springs being configured for causing independent forward movement of the shell rammer means and the shell chamber carrier from their said rearwardmost positions.

12. The automatic gun as claimed in claim 8 wherein the means for causing firing of a shell held in the shell chamber shell-holding aperture include a firing pin mounted to the shell chamber carrier in a location causing a forward end of the firing pin to impact a primer portion of a shell held in the shell chamber shell-holding aperture when the shell chamber is in the shell firing position and the shell chamber carrier reaches its forwardmost battery position.

13. The automatic gun as claimed in claim 8 including recoil buffering means mounted in the receiver in the path of rearward travel of the shell rammer means and the shell chamber carrier for absorbing rearward recoil energy thereof and thereby stop rearward recoil movement thereof.

14. The automatic gun as claimed in claim 8 wherein said means for preventing forward movement of the shell chamber carrier until the shell rammer means has moved to its forwardmost rammer position include a secondary searing means for searing up the shell chamber carrier in its rearwardmost position and secondary unsearing means responsive to movement of the shell rammer means to its said forwardmost rammer position for unsearing the secondary searing means.

15. The automatic gun as claimed in claim 8 wherein said shell rammer body comprises a laterally flexible member which is substantially rigid in an axially compressive direction.

* * * * *